US007887170B2

(12) United States Patent
Esdaile-Watts et al.

(10) Patent No.: US 7,887,170 B2
(45) Date of Patent: Feb. 15, 2011

(54) PRESSURE-REGULATING CHAMBER COMPRISING FLOAT VALVE BIASED TOWARDS CLOSURE BY INLET INK PRESSURE

(75) Inventors: Edward Ellis Esdaile-Watts, Balmain (AU); Kent Benjamen Kwan, Balmain (AU); Nicholas Kenneth Abraham, Balmain (AU); Christopher Hibbard, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 370 days.

(21) Appl. No.: 12/192,121

(22) Filed: Aug. 15, 2008

(65) Prior Publication Data

US 2009/0219326 A1 Sep. 3, 2009

Related U.S. Application Data

(60) Provisional application No. 61/033,357, filed on Mar. 3, 2008.

(51) Int. Cl.
*B41J 2/175* (2006.01)
*B41J 2/18* (2006.01)
*B41J 2/19* (2006.01)

(52) U.S. Cl. ..... 347/85; 347/89; 347/92

(58) Field of Classification Search ..... 347/85
See application file for complete search history.

(56) References Cited

U.S. PATENT DOCUMENTS

| | | | | |
|---|---|---|---|---|
| 3,929,071 | A | 12/1975 | Cialone et al. | |
| 4,677,447 | A | 6/1987 | Nielsen | |
| 5,751,319 | A | 5/1998 | Robertson et al. | |
| 6,174,052 | B1 | 1/2001 | Eremity et al. | |
| 6,428,156 | B1 | 8/2002 | Waller et al. | |
| 6,742,882 | B2 * | 6/2004 | Nakamura | 347/89 |
| 2006/0209115 | A1 | 9/2006 | Espasa et al. | |
| 2007/0195136 | A1 | 8/2007 | Senor et al. | |
| 2007/0206070 | A1 | 9/2007 | Morgan et al. | |
| 2007/0206072 | A1 | 9/2007 | Morgan et al. | |
| 2007/0222828 | A1 | 9/2007 | Stathem et al. | |

FOREIGN PATENT DOCUMENTS

| | | | |
|---|---|---|---|
| EP | 0002591 | B1 | 1/1982 |
| EP | 1038680 | A2 | 9/2000 |
| EP | 1366908 | A1 | 12/2003 |
| GB | 2265860 | A | 10/1993 |
| WO | WO 2008/006132 | A1 | 1/2008 |
| WO | WO 2008/006139 | A1 | 1/2008 |

* cited by examiner

*Primary Examiner*—Uyen-Chau N Le
*Assistant Examiner*—Kajli Prince

(57) ABSTRACT

A pressure-regulating chamber for maintaining ink contained in the chamber at a predetermined first level relative to a printhead. The chamber comprises: an inlet port for connection to an ink reservoir via an ink supply line; an outlet port for connection to an ink inlet of a printhead via an upstream ink line; an air vent open to atmosphere; and a float valve for maintaining the predetermined first level of ink by controlling a flow of ink into the inlet port. The float valve is biased towards a closed position by a positive ink pressure at the inlet port.

11 Claims, 7 Drawing Sheets

PRESSURE-REGULATING CHAMBER COMPRISING FLOAT VALVE BIASED TOWARDS CLOSURE BY INLET INK PRESSURE

FIELD OF THE INVENTION

The present invention relates to printers and in particular inkjet printers. It has been developed primarily to provide a fluidics system which controls a hydrostatic ink pressure during normal printing, whilst enabling priming and depriming for printhead replacement.

CO-PENDING APPLICATIONS

The following applications have been filed by the Applicant simultaneously with the present application:

SBF028US SBF029US SBF030US SBF031US SBF032US

The disclosures of these co-pending applications are incorporated herein by reference. The above applications have been identified by their filing docket number, which will be substituted with the corresponding application number, once assigned.

CROSS REFERENCES

The following patents or patent applications filed by the applicant or assignee of the present invention are hereby incorporated by cross-reference.

| | | | | | |
|---|---|---|---|---|---|
| 6,276,850 | 6,520,631 | 6,158,907 | 6,539,180 | 6,270,177 | 6,405,055 |
| 6,628,430 | 6,835,135 | 6,626,529 | 6,981,769 | 7,125,338 | 7,125,337 |
| 7,136,186 | 7,286,260 | 7,145,689 | 7,130,075 | 7,081,974 | 7,177,055 |
| 7,209,257 | 6,443,555 | 7,161,715 | 7,154,632 | 7,158,258 | 7,148,993 |
| 7,075,684 | 7,400,346 | 7,385,630 | 7,385,629 | 7,385,628 | 10/943,902 |
| 6,966,659 | 6,988,841 | 7,077,748 | 7,255,646 | 7,070,270 | 7,014,307 |
| 7,158,809 | 7,217,048 | 11/225,172 | 7,341,341 | 11/329,039 | 11/329,040 |
| 7,271,829 | 11/442,189 | 11/474,280 | 11/483,061 | 11/503,078 | 11/520,735 |
| 11/505,858 | 11/525,850 | 11/583,870 | 11/592,983 | 11/592,208 | 11/601,828 |
| 11/635,482 | 11/635,526 | 10/466,440 | 7,215,441 | 11/650,545 | 11/653,241 |
| 11/653,240 | 7,056,040 | 6,942,334 | 11/706,300 | 11/740,265 | 11/737,720 |
| 11/739,056 | 11/740,204 | 11/740,223 | 11/753,557 | 11/750,285 | 11/758,648 |
| 11/778,559 | 11/834,634 | 11/838,878 | 11/845,669 | 12/015,407 | 12/017,331 |
| 12/030,823 | 6,799,853 | 7,237,896 | 6,749,301 | 10/451,722 | 7,137,678 |
| 7,252,379 | 7,144,107 | 10/503,900 | 10/503,898 | 10/503,897 | 7,220,068 |
| 7,270,410 | 7,241,005 | 7,108,437 | 7,140,792 | 10/503,922 | 7,224,274 |
| 10/503,917 | 10/503,918 | 10/503,925 | 10/503,927 | 10/503,928 | 7,349,777 |
| 7,354,121 | 7,195,325 | 7,229,164 | 7,150,523 | 10/503,889 | 7,154,580 |
| 6,906,778 | 7,167,158 | 7,128,269 | 6,688,528 | 6,986,613 | 6,641,315 |
| 7,278,702 | 10/503,891 | 7,150,524 | 7,155,395 | 6,915,140 | 6,999,206 |
| 6,795,651 | 6,883,910 | 7,118,481 | 7,136,198 | 7,092,130 | 6,786,661 |
| 6,808,325 | 10/920,368 | 10/920,284 | 7,219,990 | 10/920,283 | 6,750,901 |
| 6,476,863 | 6,788,336 | 6,322,181 | 6,597,817 | 6,227,648 | 6,727,948 |
| 6,690,419 | 10/470,947 | 6,619,654 | 6,969,145 | 6,679,582 | 7,328,896 |
| 6,568,670 | 6,866,373 | 7,280,247 | 7,008,044 | 6,742,871 | 6,966,628 |
| 6,644,781 | 6,969,143 | 6,767,076 | 6,834,933 | 6,692,113 | 6,913,344 |
| 6,727,951 | 7,128,395 | 7,036,911 | 7,032,995 | 6,969,151 | 6,955,424 |
| 6,969,162 | 10/919,249 | 6,942,315 | 7,354,122 | 7,234,797 | 6,986,563 |
| 7,295,211 | 11/045,442 | 7,286,162 | 7,283,159 | 7,077,330 | 6,196,541 |
| 7,303,257 | 11/185,725 | 7,226,144 | 11/202,344 | 7,267,428 | 7,401,891 |
| 7,380,924 | 7,093,929 | 11/282,769 | 11/330,060 | 11/442,111 | 7,290,862 |
| 11/499,806 | 11/499,710 | 6,195,150 | 11/749,156 | 11/782,588 | 11/854,435 |
| 11/853,817 | 11/935,958 | 11/924,608 | 6,362,868 | 11/970,993 | 12/031,526 |
| 6,831,681 | 6,431,669 | 6,362,869 | 6,472,052 | 6,356,715 | 6,894,694 |
| 6,636,216 | 6,366,693 | 6,329,990 | 6,459,495 | 6,137,500 | 6,690,416 |
| 7,050,143 | 6,398,328 | 7,110,024 | 6,431,704 | 6,879,341 | 6,415,054 |
| 6,665,454 | 6,542,645 | 6,486,886 | 6,381,361 | 6,317,192 | 6,850,274 |
| 09/113,054 | 6,646,757 | 6,624,848 | 6,357,135 | 6,271,931 | 6,353,772 |
| 6,106,147 | 6,665,008 | 6,304,291 | 6,305,770 | 6,289,262 | 6,315,200 |
| 6,217,165 | 6,496,654 | 6,859,225 | 6,924,835 | 6,647,369 | 6,943,830 |
| 09/693,317 | 7,021,745 | 6,712,453 | 6,460,971 | 6,428,147 | 6,416,170 |

-continued

| | | | | | |
|---|---|---|---|---|---|
| 6,402,300 | 6,464,340 | 6,612,687 | 6,412,912 | 6,447,099 | 6,837,567 |
| 6,505,913 | 7,128,845 | 6,733,684 | 7,249,108 | 6,566,858 | 6,331,946 |
| 6,246,970 | 6,442,525 | 7,346,586 | 09/505,951 | 6,374,354 | 7,246,098 |
| 6,816,968 | 6,757,832 | 6,334,190 | 6,745,331 | 7,249,109 | 7,197,642 |
| 7,093,139 | 10/636,263 | 10/636,283 | 10/866,608 | 7,210,038 | 7,401,223 |
| 10/940,653 | 10/942,858 | 11/706,329 | 11/757,385 | 11/758,642 | 12/030,817 |
| 7,119,836 | 7,283,162 | 7,286,169 | 10/636,285 | 7,170,652 | 6,967,750 |
| 6,995,876 | 7,099,051 | 7,172,191 | 7,243,916 | 7,222,845 | 11/239,232 |
| 7,285,227 | 7,063,940 | 11/107,942 | 7,193,734 | 7,086,724 | 7,090,337 |
| 7,278,723 | 7,140,717 | 11/190,902 | 11/209,711 | 7,256,824 | 7,140,726 |
| 7,156,512 | 7,186,499 | 11/478,585 | 11/525,862 | 7,357,497 | 11/583,875 |
| 7,404,633 | 6,750,944 | 11/599,336 | 7,291,447 | 11/744,183 | 11/758,646 |
| 11/778,561 | 11/839,532 | 11/838,874 | 11/853,021 | 11/869,710 | 11/868,531 |
| 11/927,403 | 11/951,960 | 12/019,556 | 10/636,225 | 6,985,207 | 6,773,874 |
| 6,650,836 | 7,324,142 | 10/636,224 | 7,250,975 | 7,295,343 | 6,880,929 |
| 7,236,188 | 7,236,187 | 7,155,394 | 10/636,219 | 10/636,223 | 7,055,927 |
| 6,986,562 | 7,052,103 | 7,312,845 | 10/656,281 | 10/656,791 | 7,375,746 |
| 10/683,217 | 7,289,142 | 7,095,533 | 6,914,686 | 6,896,252 | 6,820,871 |
| 6,834,851 | 6,848,686 | 6,830,246 | 6,851,671 | 10/729,098 | 7,092,011 |
| 7,187,404 | 10/729,159 | 10/753,458 | 6,878,299 | 6,929,348 | 6,921,154 |
| 10/780,625 | 10/804,042 | 6,913,346 | 10/831,238 | 10/831,237 | 10/831,239 |
| 7,385,639 | 10/831,241 | 10/831,234 | 10/831,233 | 7,246,897 | 7,077,515 |
| 10/831,235 | 10/853,336 | 10/853,117 | 10/853,659 | 10/853,681 | 6,913,875 |
| 7,021,758 | 7,033,017 | 7,161,709 | 7,099,033 | 7,147,294 | 7,156,494 |
| 7,360,872 | 11/011,925 | 7,032,998 | 7,044,585 | 7,296,867 | 6,994,424 |
| 7,384,134 | 7,258,435 | 7,097,263 | 7,001,012 | 7,004,568 | 7,040,738 |
| 7,188,933 | 7,027,080 | 7,025,446 | 6,991,321 | 7,131,715 | 7,261,392 |
| 7,207,647 | 7,182,435 | 7,097,285 | 7,331,646 | 7,097,284 | 7,083,264 |
| 7,147,304 | 7,232,203 | 7,156,498 | 7,201,471 | 11/501,772 | 11/503,084 |
| 11/513,073 | 7,210,764 | 7,381,342 | 11/706,379 | 11/730,386 | 11/730,784 |
| 7,407,265 | 11/782,591 | 11/859,783 | 12/015,243 | 12/037,069 | 6,710,457 |
| 6,775,906 | 6,507,099 | 7,221,043 | 7,107,674 | 7,154,172 | 7,402,894 |
| 7,247,941 | 7,402,896 | 7,307,354 | 11/940,304 | 6,530,339 | 6,631,897 |
| 6,851,667 | 6,830,243 | 6,860,479 | 6,997,452 | 7,000,913 | 7,204,482 |
| 7,398,967 | 11/281,679 | 7,401,989 | 6,238,044 | 6,425,661 | 7,364,256 |
| 7,258,417 | 7,293,853 | 7,328,968 | 7,270,395 | 11/003,404 | 11/003,419 |
| 7,334,864 | 7,255,419 | 7,284,819 | 7,229,148 | 7,258,416 | 7,273,263 |
| 7,270,393 | 6,984,017 | 7,347,526 | 7,357,477 | 7,156,497 | 11/601,670 |
| 11/748,482 | 11/778,563 | 11/779,851 | 11/778,574 | 11/853,816 | 11/853,814 |
| 11/853,786 | 11/872,037 | 11/856,694 | 11/965,703 | 11/971,170 | 12/023,011 |
| 12/036,896 | 12/050,154 | 11/003,463 | 7,364,255 | 12/056,247 | 7,357,476 |
| 12/050,001 | 11/003,614 | 7,284,820 | 7,341,328 | 7,246,875 | 7,322,669 |
| 11/764,760 | 11/853,777 | 11/955,354 | 12/022,994 | 11/293,800 | 11/293,802 |
| 11/293,801 | 11/293,808 | 11/293,809 | 11/482,975 | 11/482,970 | 11/482,968 |
| 11/482,972 | 11/482,971 | 11/482,969 | 6,431,777 | 6,334,664 | 6,447,113 |
| 7,239,407 | 6,398,359 | 6,652,089 | 6,652,090 | 7,057,759 | 6,631,986 |
| 7,187,470 | 7,280,235 | 11/501,775 | 11/744,210 | 11/859,784 | 6,471,331 |
| 6,676,250 | 6,347,864 | 6,439,704 | 6,425,700 | 6,588,952 | 6,626,515 |
| 6,722,758 | 6,871,937 | 11/060,803 | 7,344,226 | 7,328,976 | 11/685,084 |
| 11/685,086 | 11/685,090 | 11/740,925 | 11/763,444 | 11/763,443 | 11/946,840 |
| 11/961,712 | 12/017,771 | 7,249,942 | 7,206,654 | 7,162,324 | 7,162,325 |
| 7,231,275 | 7,146,236 | 7,278,847 | 10/753,499 | 6,997,698 | 7,220,112 |
| 7,231,276 | 7,373,214 | 7,220,115 | 7,195,475 | 7,144,242 | 7,306,323 |
| 7,306,319 | 11/525,858 | 7,322,674 | 11/599,335 | 11/706,380 | 11/736,545 |
| 11/736,554 | 11/739,047 | 11/749,159 | 11/739,073 | 11/775,160 | 11/853,755 |
| 11/940,291 | 11/934,071 | 11/951,913 | 6,786,420 | 6,827,282 | 6,948,661 |
| 7,073,713 | 10/983,060 | 7,093,762 | 7,083,108 | 7,222,799 | 7,201,319 |
| 11/442,103 | 11/739,071 | 11/518,238 | 11/518,280 | 11/518,244 | 11/518,243 |
| 11/518,242 | 7,032,899 | 6,854,724 | 7,331,651 | 7,334,870 | 7,334,875 |
| 11/357,296 | 11/357,298 | 11/357,297 | 12/015,479 | 12/017,270 | 12/015,218 |
| 6,350,023 | 6,318,849 | 6,592,207 | 6,439,699 | 6,312,114 | 11/246,676 |
| 11/246,677 | 11/246,678 | 11/246,679 | 11/246,680 | 11/246,681 | 11/246,714 |
| 11/246,713 | 7,399,057 | 11/246,671 | 11/246,670 | 11/246,669 | 11/246,704 |
| 11/246,710 | 11/246,688 | 7,399,054 | 11/246,715 | 7,367,648 | 7,370,936 |
| 7,401,886 | 11/246,708 | 7,401,887 | 7,384,119 | 7,401,888 | 7,387,358 |
| 11/246,694 | 11/482,958 | 11/482,955 | 11/482,962 | 11/482,963 | 11/482,956 |
| 11/482,954 | 11/482,974 | 11/482,957 | 11/482,987 | 11/482,959 | 11/482,960 |
| 11/482,961 | 11/482,964 | 11/482,965 | 11/482,976 | 11/482,973 | 11/495,815 |
| 11/495,816 | 11/495,817 | 60/992,635 | 61/992,637 | 61/992,641 | 12/050,078 |
| 12/050,066 | 10/803,074 | 10/803,073 | 7,040,823 | 10/803,076 | 10/803,077 |
| 10/803,078 | 10/803,079 | 10/922,971 | 10/922,970 | 10/922,836 | 10/922,842 |
| 10/922,848 | 10/922,843 | 7,125,185 | 7,229,226 | 7,364,378 | 11/753,559 |
| 12/056,276 | 10/815,621 | 7,243,835 | 10/815,630 | 10/815,637 | 10/815,638 |
| 7,251,050 | 10/815,642 | 7,097,094 | 7,137,549 | 10/815,618 | 7,156,292 |
| 11/738,974 | 12/047,321 | 10/815,635 | 7,357,323 | 10/815,634 | 7,137,566 |
| 7,131,596 | 7,128,265 | 7,207,485 | 7,197,374 | 7,175,089 | 10/815,617 |
| 10/815,620 | 7,178,719 | 10/815,613 | 7,207,483 | 7,296,737 | 7,270,266 |
| 10/815,614 | 7,314,181 | 11/488,162 | 11/488,163 | 11/488,164 | 11/488,167 |
| 11/488,168 | 11/488,165 | 11/488,166 | 7,267,273 | 7,383,991 | 7,383,984 |

-continued

| | | | | | |
|---|---|---|---|---|---|
| 11/944,449 | 12/043,851 | 10/815,636 | 7,128,270 | 11/041,650 | 11/041,651 |
| 11/041,652 | 11/041,649 | 11/041,610 | 11/863,253 | 11/863,255 | 11/863,257 |
| 11/863,258 | 11/863,262 | 11/041,609 | 11/041,626 | 11/041,627 | 11/041,624 |
| 7,395,963 | 11/863,268 | 11/863,269 | 11/863,270 | 11/863,271 | 11/863,273 |
| 12/056,260 | 12/056,254 | 76,584,733 | 11/041,556 | 11/041,580 | 11/041,723 |
| 11/041,698 | 11/041,648 | 11/863,263 | 11/863,264 | 11/863,265 | 11/863,266 |
| 11/863,267 | 10/815,609 | 7,150,398 | 7,159,777 | 10/815,610 | 7,188,769 |
| 7,097,106 | 7,070,110 | 7,243,849 | 7,314,177 | 11/480,957 | 11/764,694 |
| 11/957,470 | 6,227,652 | 6,213,588 | 6,213,589 | 6,231,163 | 6,247,795 |
| 6,394,581 | 6,244,691 | 6,257,704 | 6,416,168 | 6,220,694 | 6,257,705 |
| 6,247,794 | 6,234,610 | 6,247,793 | 6,264,306 | 6,241,342 | 6,247,792 |
| 6,264,307 | 6,254,220 | 6,234,611 | 6,302,528 | 6,283,582 | 6,239,821 |
| 6,338,547 | 6,247,796 | 6,557,977 | 6,390,603 | 6,362,843 | 6,293,653 |
| 6,312,107 | 6,227,653 | 6,234,609 | 6,238,040 | 6,188,415 | 6,227,654 |
| 6,209,989 | 6,247,791 | 6,336,710 | 6,217,153 | 6,416,167 | 6,243,113 |
| 6,283,581 | 6,247,790 | 6,260,953 | 6,267,469 | 6,588,882 | 6,742,873 |
| 6,918,655 | 6,547,371 | 6,938,989 | 6,598,964 | 6,923,526 | 6,273,544 |
| 6,309,048 | 6,420,196 | 6,443,558 | 6,439,689 | 6,378,989 | 6,848,181 |
| 6,634,735 | 6,299,289 | 6,299,290 | 6,425,654 | 6,902,255 | 6,623,101 |
| 6,406,129 | 6,505,916 | 6,457,809 | 6,550,895 | 6,457,812 | 7,152,962 |
| 6,428,133 | 7,216,956 | 7,080,895 | 11/144,844 | 7,182,437 | 7,357,485 |
| 7,387,368 | 11/607,976 | 11/607,975 | 11/607,999 | 11/607,980 | 11/607,979 |
| 11/607,978 | 11/735,961 | 11/685,074 | 11/696,126 | 11/696,144 | 7,384,131 |
| 11/763,446 | 12/043,820 | 6,224,780 | 6,235,212 | 6,280,643 | 6,284,147 |
| 6,214,244 | 6,071,750 | 6,267,905 | 6,251,298 | 6,258,285 | 6,225,138 |
| 6,241,904 | 6,299,786 | 6,866,789 | 6,231,773 | 6,190,931 | 6,248,249 |
| 6,290,862 | 6,241,906 | 6,565,762 | 6,241,905 | 6,451,216 | 6,231,772 |
| 6,274,056 | 6,290,861 | 6,248,248 | 6,306,671 | 6,331,258 | 6,110,754 |
| 6,294,101 | 6,416,679 | 6,264,849 | 6,254,793 | 6,245,246 | 6,855,264 |
| 6,235,211 | 6,491,833 | 6,264,850 | 6,258,284 | 6,312,615 | 6,228,668 |
| 6,180,427 | 6,171,875 | 6,267,904 | 6,245,247 | 6,315,914 | 7,169,316 |
| 6,526,658 | 7,210,767 | 7,390,421 | 11/635,523 | 6,665,094 | 6,450,605 |
| 6,512,596 | 6,654,144 | 7,125,090 | 6,687,022 | 7,072,076 | 7,092,125 |
| 7,215,443 | 7,136,195 | 7,077,494 | 6,877,834 | 6,969,139 | 10/636,227 |
| 7,283,280 | 6,912,067 | 7,277,205 | 7,154,637 | 10/636,230 | 7,070,251 |
| 6,851,782 | 10/636,211 | 10/636,247 | 6,843,545 | 7,079,286 | 7,064,867 |
| 7,065,247 | 7,027,177 | 7,218,415 | 7,064,873 | 6,954,276 | 7,061,644 |
| 7,092,127 | 7,059,695 | 10/990,382 | 7,177,052 | 7,270,394 | 11/124,231 |
| 7,188,921 | 7,187,469 | 7,196,820 | 11/281,445 | 7,283,281 | 7,251,051 |
| 7,245,399 | 11/524,911 | 7,372,598 | 7,382,488 | 7,365,874 | 7,349,125 |
| 7,336,397 | 11/834,637 | 11/853,019 | 11/863,239 | 12/015,485 | 12/030,797 |
| 12/050,933 | 11/305,274 | 11/305,273 | 11/305,275 | 11/305,152 | 11/305,158 |
| 11/305,008 | 6,231,148 | 6,293,658 | 6,614,560 | 6,238,033 | 6,312,070 |
| 6,238,111 | 6,378,970 | 6,196,739 | 6,270,182 | 6,152,619 | 7,006,143 |
| 6,876,394 | 6,738,096 | 6,970,186 | 6,287,028 | 6,412,993 | 11/033,145 |
| 11/102,845 | 11/102,861 | 11/248,421 | 11/672,878 | 7,204,941 | 7,282,164 |
| 10/815,628 | 11/845,672 | 7,278,727 | 10/913,373 | 10/913,374 | 7,367,665 |
| 7,138,391 | 7,153,956 | 10/913,380 | 10/913,379 | 10/913,376 | 7,122,076 |
| 7,148,345 | 11/172,816 | 11/172,815 | 11/172,814 | 11/482,990 | 11/482,986 |
| 11/482,985 | 11/454,899 | 11/583,942 | 11/592,990 | 11/849,360 | 11/831,961 |
| 11/831,962 | 11/831,963 | 11/832,629 | 11/832,637 | 61/027,756 | 12/055,316 |
| 10/407,212 | 7,252,366 | 10/683,064 | 7,360,865 | 7,275,811 | 10/884,889 |
| 10/922,890 | 7,334,874 | 7,393,083 | 10/922,889 | 10/922,884 | 10/922,879 |
| 10/922,887 | 10/922,888 | 10/922,874 | 7,234,795 | 7,401,884 | 7,328,975 |
| 7,293,855 | 10/922,882 | 7,401,900 | 10/922,878 | 10/922,872 | 7,360,871 |
| 10/922,886 | 10/922,877 | 7,147,792 | 7,175,774 | 7,404,625 | 7,350,903 |
| 11/766,713 | 11/841,647 | 12/018,040 | 12/035,410 | 12/037,054 | 11/482,980 |
| 11/563,684 | 11/482,967 | 11/482,966 | 11/482,988 | 11/482,989 | 11/293,832 |
| 11/293,838 | 11/293,825 | 11/293,841 | 11/293,799 | 11/293,796 | 11/293,797 |
| 11/293,798 | 11/124,158 | 11/124,196 | 11/124,199 | 11/124,162 | 11/124,202 |
| 11/124,197 | 11/124,154 | 11/124,198 | 7,284,921 | 11/124,151 | 7,407,257 |
| 11/124,192 | 11/124,175 | 7,392,950 | 11/124,149 | 7,360,880 | 11/124,173 |
| 11/124,155 | 7,236,271 | 11/124,174 | 11/124,194 | 11/124,164 | 11/124,200 |
| 11/124,195 | 11/124,166 | 11/124,150 | 11/124,172 | 11/124,165 | 11/124,186 |
| 11/124,185 | 11/124,184 | 11/124,182 | 11/124,201 | 11/124,171 | 11/124,181 |
| 11/124,161 | 11/124,156 | 11/124,191 | 11/124,159 | 11/124,176 | 7,370,932 |
| 7,404,616 | 11/124,187 | 11/124,189 | 11/124,190 | 11/124,180 | 11/124,193 |
| 11/124,183 | 11/124,178 | 11/124,177 | 11/124,148 | 11/124,168 | 11/124,167 |
| 11/124,179 | 11/124,169 | 11/187,976 | 11/188,011 | 11/188,014 | 11/482,979 |
| 11/735,490 | 11/853,018 | 11/944,450 | 12/023,815 | 12/035,414 | 12/056,232 |
| 11/228,540 | 11/228,500 | 11/228,501 | 11/228,530 | 11/228,490 | 11/228,531 |
| 11/228,504 | 11/228,533 | 11/228,502 | 11/228,507 | 11/228,482 | 11/228,505 |
| 11/228,497 | 11/228,487 | 11/228,529 | 11/228,484 | 11/228,489 | 11/228,518 |
| 11/228,536 | 11/228,496 | 11/228,488 | 11/228,506 | 11/228,516 | 11/228,526 |
| 11/228,539 | 11/228,538 | 11/228,524 | 11/228,523 | 11/228,519 | 11/228,528 |
| 11/228,527 | 7,403,797 | 11/228,520 | 11/228,498 | 11/228,511 | 11/228,522 |
| 11/228,515 | 11/228,537 | 11/228,534 | 11/228,491 | 11/228,499 | 11/228,509 |
| 11/228,492 | 11/228,493 | 11/228,510 | 11/228,508 | 11/228,512 | 11/228,514 |
| 11/228,494 | 11/228,495 | 11/228,486 | 11/228,481 | 11/228,477 | 7,357,311 |

-continued

| | | | | | |
|---|---|---|---|---|---|
| 7,380,709 | 11/228,521 | 7,403,796 | 7,407,092 | 11/228,513 | 11/228,503 |
| 11/228,480 | 11/228,535 | 11/228,478 | 11/228,479 | 12/035,419 | 6,238,115 |
| 6,386,535 | 6,398,344 | 6,612,240 | 6,752,549 | 6,805,049 | 6,971,313 |
| 6,899,480 | 6,860,664 | 6,925,935 | 6,966,636 | 7,024,995 | 7,284,852 |
| 6,926,455 | 7,056,038 | 6,869,172 | 7,021,843 | 6,988,845 | 6,964,533 |
| 6,981,809 | 7,284,822 | 7,258,067 | 7,322,757 | 7,222,941 | 7,284,925 |
| 7,278,795 | 7,249,904 | 7,364,286 | 11/772,240 | 11/863,246 | 11/863,145 |
| 11/865,650 | 12/050,091 | 12/050,106 | 6,087,638 | 6,340,222 | 6,041,600 |
| 6,299,300 | 6,067,797 | 6,286,935 | 6,044,646 | 6,382,769 | 6,787,051 |
| 6,938,990 | 11/242,916 | 11/144,799 | 11/198,235 | 11/861,282 | 11/861,284 |
| 11/766,052 | 7,152,972 | 11/592,996 | D529952 | 6,390,605 | 6,322,195 |
| 6,612,110 | 6,480,089 | 6,460,778 | 6,305,788 | 6,426,014 | 6,364,453 |
| 6,457,795 | 6,315,399 | 6,338,548 | 7,040,736 | 6,938,992 | 6,994,425 |
| 6,863,379 | 6,540,319 | 6,994,421 | 6,984,019 | 7,008,043 | 6,997,544 |
| 6,328,431 | 6,991,310 | 10/965,772 | 7,140,723 | 6,328,425 | 6,982,184 |
| 7,267,423 | 7,134,741 | 7,066,577 | 7,152,945 | 7,303,689 | 7,021,744 |
| 6,991,320 | 7,155,911 | 11/107,799 | 6,595,624 | 7,152,943 | 7,125,103 |
| 7,328,971 | 7,290,857 | 7,285,437 | 7,229,151 | 7,341,331 | 7,237,873 |
| 11/329,163 | 11/442,180 | 11/450,431 | 7,213,907 | 6,417,757 | 11/482,951 |
| 11/545,566 | 11/583,826 | 11/604,315 | 11/604,323 | 7,387,364 | 11/706,950 |
| 11/730,399 | 11/749,121 | 11/753,549 | 11/834,630 | 11/935,389 | 11/869,670 |
| 7,095,309 | 11/945,169 | 11/957,473 | 11/967,235 | 12/017,896 | 6,854,825 |
| 6,623,106 | 6,672,707 | 6,575,561 | 6,817,700 | 6,588,885 | 7,075,677 |
| 6,428,139 | 6,575,549 | 6,846,692 | 6,425,971 | 7,063,993 | 6,383,833 |
| 6,955,414 | 6,412,908 | 6,746,105 | 6,953,236 | 6,412,904 | 7,128,388 |
| 6,398,343 | 6,652,071 | 6,793,323 | 6,659,590 | 6,676,245 | 7,201,460 |
| 6,464,332 | 6,659,593 | 6,478,406 | 6,978,613 | 6,439,693 | 6,502,306 |
| 6,966,111 | 6,863,369 | 6,428,142 | 6,874,868 | 6,390,591 | 6,799,828 |
| 6,896,358 | 7,018,016 | 7,380,905 | 6,328,417 | 6,322,194 | 6,382,779 |
| 6,629,745 | 6,565,193 | 6,609,786 | 6,609,787 | 6,439,908 | 6,684,503 |
| 6,843,551 | 6,764,166 | 6,561,617 | 7,328,967 | 6,557,970 | 6,546,628 |
| 7,407,269 | 6,652,074 | 6,820,968 | 7,175,260 | 6,682,174 | 7,303,262 |
| 6,648,453 | 6,834,932 | 6,682,176 | 6,998,062 | 6,767,077 | 7,278,717 |
| 6,755,509 | 7,347,537 | 6,692,108 | 7,407,271 | 6,672,709 | 7,303,263 |
| 7,086,718 | 10/534,881 | 6,672,710 | 10/534,812 | 6,669,334 | 7,322,686 |
| 7,152,958 | 7,281,782 | 6,824,246 | 7,264,336 | 6,669,333 | 7,357,489 |
| 6,820,967 | 7,306,326 | 6,736,489 | 7,264,335 | 6,719,406 | 7,222,943 |
| 7,188,419 | 7,168,166 | 6,974,209 | 7,086,719 | 6,974,210 | 7,195,338 |
| 7,252,775 | 7,101,025 | 11/474,281 | 11/485,258 | 11/706,304 | 11/706,324 |
| 11/706,326 | 11/706,321 | 11/772,239 | 7,401,903 | 11/829,941 | 11/852,991 |
| 11/852,986 | 11/936,062 | 11/934,027 | 11/955,028 | 12/034,578 | 12/036,908 |
| 11/763,440 | 11/763,442 | 11/246,687 | 11/246,718 | 7,322,681 | 11/246,686 |
| 11/246,703 | 11/246,691 | 11/246,711 | 11/246,690 | 11/246,712 | 11/246,717 |
| 7,401,890 | 7,401,910 | 11/246,701 | 11/246,702 | 11/246,668 | 11/246,697 |
| 11/246,698 | 11/246,699 | 11/246,675 | 11/246,674 | 11/246,667 | 11/829,957 |
| 11/829,960 | 11/829,961 | 11/829,962 | 11/829,963 | 11/829,966 | 11/829,967 |
| 11/829,968 | 11/829,969 | 11/946,839 | 11/946,838 | 11/946,837 | 11/951,230 |
| 7,156,508 | 7,159,972 | 7,083,271 | 7,165,834 | 7,080,894 | 7,201,469 |
| 7,090,336 | 7,156,489 | 10/760,233 | 10/760,246 | 7,083,257 | 7,258,422 |
| 7,255,423 | 7,219,980 | 10/760,253 | 10/760,255 | 7,367,649 | 7,118,192 |
| 10/760,194 | 7,322,672 | 7,077,505 | 7,198,354 | 7,077,504 | 10/760,189 |
| 7,198,355 | 7,401,894 | 7,322,676 | 7,152,959 | 7,213,906 | 7,178,901 |
| 7,222,938 | 7,108,353 | 7,104,629 | 11/446,227 | 7,370,939 | 11/472,345 |
| 7,404,621 | 7,261,401 | 11/474,279 | 11/482,939 | 7,328,972 | 7,322,673 |
| 7,306,324 | 7,306,325 | 11/603,824 | 7,399,071 | 11/601,672 | 7,303,261 |
| 11/653,253 | 11/706,328 | 11/706,299 | 7,399,053 | 11/737,080 | 11/737,041 |
| 11/778,062 | 11/778,566 | 11/782,593 | 7,404,623 | 11/945,157 | 11/951,095 |
| 11/951,828 | 11/954,906 | 11/954,949 | 11/967,226 | 7,303,930 | 11/246,672 |
| 7,401,405 | 11/246,683 | 11/246,682 | 11/860,538 | 11/860,539 | 11/860,540 |
| 11/860,541 | 11/860,542 | 11/936,060 | 11/877,667 | 11/877,668 | 12/046,451 |
| 12/046,452 | 12/046,453 | 12/046,454 | 7,246,886 | 7,128,400 | 7,108,355 |
| 6,991,322 | 7,287,836 | 7,118,197 | 10/728,784 | 7,364,269 | 7,077,493 |
| 6,962,402 | 10/728,803 | 7,147,308 | 10/728,779 | 7,118,198 | 7,168,790 |
| 7,172,270 | 7,229,155 | 6,830,318 | 7,195,342 | 7,175,261 | 10/773,183 |
| 7,108,356 | 7,118,202 | 10/773,186 | 7,134,744 | 10/773,185 | 7,134,743 |
| 7,182,439 | 7,210,768 | 10/773,187 | 7,134,745 | 7,156,484 | 7,118,201 |
| 7,111,926 | 10/773,184 | 7,018,021 | 7,401,901 | 11/060,805 | 11/188,017 |
| 7,128,402 | 7,387,369 | 11/329,157 | 11/490,041 | 11/501,767 | 7,284,839 |
| 7,246,885 | 7,229,156 | 11/505,846 | 11/505,857 | 7,293,858 | 11/524,908 |
| 11/524,938 | 7,258,427 | 11/524,912 | 7,278,716 | 11/592,995 | 11/603,825 |
| 11/649,773 | 11/650,549 | 11/653,237 | 11/706,378 | 11/706,962 | 11/749,118 |
| 11/754,937 | 11/749,120 | 11/744,885 | 11/779,850 | 11/765,439 | 11/842,950 |
| 11/839,539 | 11/926,121 | 12/025,621 | 11/097,308 | 11/097,309 | 7,246,876 |
| 11/097,299 | 11/097,310 | 7,377,623 | 7,328,978 | 7,334,876 | 7,147,306 |
| 7,261,394 | 11/764,806 | 11/782,595 | 11/965,696 | 12/017,286 | 11/482,953 |
| 11/482,977 | 11/544,778 | 11/544,779 | 12/056,149 | 11/764,808 | 7,376,273 |
| 11/756,625 | 11/756,626 | 7,400,769 | 11/756,628 | 11/756,629 | 11/756,630 |
| 11/756,631 | 7,156,289 | 7,178,718 | 7,225,979 | 7,380,712 | 11/084,796 |
| 11/084,742 | 11/084,806 | 09/575,197 | 7,079,712 | 6,825,945 | 7,330,974 |

-continued

| | | | | | |
|---|---|---|---|---|---|
| 6,813,039 | 7,190,474 | 6,987,506 | 6,824,044 | 7,038,797 | 6,980,318 |
| 6,816,274 | 7,102,772 | 7,350,236 | 6,681,045 | 6,678,499 | 6,679,420 |
| 6,963,845 | 6,976,220 | 6,728,000 | 7,110,126 | 7,173,722 | 6,976,035 |
| 6,813,558 | 6,766,942 | 6,965,454 | 6,995,859 | 7,088,459 | 6,720,985 |
| 7,286,113 | 6,922,779 | 6,978,019 | 6,847,883 | 7,131,058 | 7,295,839 |
| 7,406,445 | 09/693,690 | 6,959,298 | 6,973,450 | 7,150,404 | 6,965,882 |
| 7,233,924 | 09/575,181 | 09/722,174 | 7,175,079 | 7,162,259 | 6,718,061 |
| 10/291,523 | 10/291,471 | 7,012,710 | 6,825,956 | 10/291,481 | 7,222,098 |
| 10/291,825 | 7,263,508 | 7,031,010 | 6,972,864 | 6,862,105 | 7,009,738 |
| 6,989,911 | 6,982,807 | 10/291,576 | 6,829,387 | 6,714,678 | 6,644,545 |
| 6,609,653 | 6,651,879 | 10/291,555 | 7,293,240 | 10/291,592 | 10/291,542 |
| 7,044,363 | 7,004,390 | 6,867,880 | 7,034,953 | 6,987,581 | 7,216,224 |
| 10/291,821 | 7,162,269 | 7,162,222 | 7,290,210 | 7,293,233 | 7,293,234 |
| 6,850,931 | 6,865,570 | 6,847,961 | 10/685,523 | 10/685,583 | 7,162,442 |
| 10/685,584 | 7,159,784 | 10/804,034 | 7,404,144 | 6,889,896 | 10/831,232 |
| 7,174,056 | 6,996,274 | 7,162,088 | 7,388,985 | 10/943,872 | 7,362,463 |
| 7,259,884 | 10/944,043 | 7,167,270 | 7,388,685 | 6,986,459 | 10/954,170 |
| 7,181,448 | 10/981,626 | 10/981,616 | 7,324,989 | 7,231,293 | 7,174,329 |
| 7,369,261 | 7,295,922 | 7,200,591 | 11/020,106 | 11/020,260 | 11/020,321 |
| 11/020,319 | 11/026,045 | 7,347,357 | 11/051,032 | 7,382,482 | 11/107,944 |
| 11/107,941 | 11/082,940 | 11/082,815 | 7,389,423 | 7,401,227 | 6,991,153 |
| 6,991,154 | 11/124,256 | 11/123,136 | 11/154,676 | 7,322,524 | 11/182,002 |
| 11/202,251 | 11/202,252 | 11/202,253 | 7,408,670 | 11/202,218 | 11/206,778 |
| 11/203,424 | 11/222,977 | 7,327,485 | 11/227,239 | 11/286,334 | 7,225,402 |
| 11/329,187 | 11/349,143 | 11/491,225 | 11/491,121 | 11/442,428 | 11/454,902 |
| 11/442,385 | 11/478,590 | 7,271,931 | 11/520,170 | 11/603,057 | 11/706,964 |
| 11/739,032 | 11/739,014 | 7,336,389 | 11/830,848 | 11/830,849 | 11/839,542 |
| 11/866,394 | 11/934,077 | 11/951,874 | 12/015,487 | 12/023,860 | 12/023,005 |
| 12/036,266 | 12/047,311 | 12/047,276 | 12/050,927 | 7,068,382 | 7,007,851 |
| 6,957,921 | 6,457,883 | 7,044,381 | 11/203,205 | 7,094,910 | 7,091,344 |
| 7,122,685 | 7,038,066 | 7,099,019 | 7,062,651 | 6,789,194 | 6,789,191 |
| 10/900,129 | 7,278,018 | 7,360,089 | 10/982,975 | 10/983,029 | 11/331,109 |
| 6,644,642 | 6,502,614 | 6,622,999 | 6,669,385 | 6,827,116 | 7,011,128 |
| 10/949,307 | 6,549,935 | 6,987,573 | 6,727,996 | 6,591,884 | 6,439,706 |
| 6,760,119 | 7,295,332 | 7,064,851 | 6,826,547 | 6,290,349 | 6,428,155 |
| 6,785,016 | 6,831,682 | 6,741,871 | 6,927,871 | 6,980,306 | 6,965,439 |
| 6,840,606 | 7,036,918 | 6,977,746 | 6,970,264 | 7,068,389 | 7,093,991 |
| 7,190,491 | 10/901,154 | 10/932,044 | 10/962,412 | 7,177,054 | 7,364,282 |
| 10/965,733 | 10/965,933 | 10/974,742 | 10/982,974 | 7,180,609 | 10/986,375 |
| 11/107,817 | 7,292,363 | 11/149,160 | 11/206,756 | 11/250,465 | 7,202,959 |
| 11/653,219 | 11/706,309 | 11/730,389 | 11/730,392 | 11/866,387 | 12/050,161 |
| 6,982,798 | 6,870,966 | 6,822,639 | 6,474,888 | 6,627,870 | 6,724,374 |
| 6,788,982 | 7,263,270 | 6,788,293 | 6,946,672 | 6,737,591 | 7,091,960 |
| 7,369,265 | 6,792,165 | 7,105,753 | 6,795,593 | 6,980,704 | 6,768,821 |
| 7,132,612 | 7,041,916 | 6,797,895 | 7,015,901 | 7,289,882 | 7,148,644 |
| 10/778,056 | 10/778,058 | 10/778,060 | 10/778,059 | 10/778,063 | 10/778,062 |
| 10/778,061 | 10/778,057 | 7,096,199 | 7,286,887 | 7,400,937 | 10/917,466 |
| 7,324,859 | 7,218,978 | 7,245,294 | 7,277,085 | 7,187,370 | 10/917,436 |
| 10/943,856 | 10/919,379 | 7,019,319 | 10/943,878 | 10/943,849 | 7,043,096 |
| 7,148,499 | 11/144,840 | 11/155,556 | 11/155,557 | 11/193,481 | 11/193,435 |
| 11/193,482 | 11/193,479 | 7,336,267 | 7,388,221 | 11/298,474 | 7,245,760 |
| 11/488,832 | 11/495,814 | 11/495,823 | 11/495,822 | 11/495,821 | 11/495,820 |
| 11/653,242 | 7,358,697 | 11/829,936 | 11/839,494 | 11/866,305 | 11/866,313 |
| 11/866,324 | 11/866,336 | 11/866,348 | 11/866,359 | 11/970,951 | 12/036,264 |
| 7,055,739 | 7,233,320 | 6,830,196 | 6,832,717 | 7,182,247 | 7,120,853 |
| 7,082,562 | 6,843,420 | 10/291,718 | 6,789,731 | 7,057,608 | 6,766,944 |
| 6,766,945 | 7,289,103 | 10/291,559 | 7,299,969 | 7,264,173 | 10/409,864 |
| 7,108,192 | 10/537,159 | 7,111,791 | 7,077,333 | 6,983,878 | 10/786,631 |
| 7,134,598 | 10/893,372 | 6,929,186 | 6,994,264 | 7,017,826 | 7,014,123 |
| 7,134,601 | 7,150,396 | 10/971,146 | 7,017,823 | 7,025,276 | 7,284,701 |
| 7,080,780 | 7,376,884 | 7,334,739 | 7,380,727 | 11/842,948 | 12/015,477 |
| 12/025,746 | 12/025,747 | 12/025,748 | 12/025,749 | 12/025,750 | 12/025,751 |
| 12/025,754 | 12/025,756 | 12/025,757 | 12/025,759 | 12/025,760 | 12/025,761 |
| 12/025,762 | 12/025,764 | 12/025,765 | 12/025,766 | 12/025,767 | 12/025,768 |
| 10/492,169 | 10/492,152 | 7,359,551 | 10/492,161 | 7,308,148 | 10/502,575 |
| 10/531,229 | 10/531,733 | 10/683,040 | 10/510,391 | 10/510,392 | 10/778,090 |
| 11/944,404 | 11/936,638 | 12/031,615 | 6,957,768 | 09/575,172 | 7,170,499 |
| 7,106,888 | 7,123,239 | 6,982,701 | 6,982,703 | 7,227,527 | 6,786,397 |
| 6,947,027 | 6,975,299 | 7,139,431 | 7,048,178 | 7,118,025 | 6,839,053 |
| 7,015,900 | 7,010,147 | 7,133,557 | 6,914,593 | 10/291,546 | 6,938,826 |
| 7,278,566 | 7,123,245 | 6,992,662 | 7,190,346 | 11/074,800 | 11/074,782 |
| 7,382,354 | 11/075,917 | 7,221,781 | 11/102,843 | 7,213,756 | 7,362,314 |
| 7,180,507 | 7,263,225 | 7,287,688 | 11/737,094 | 11/753,570 | 11/782,596 |
| 11/865,711 | 12/054,194 | 12/049,376 | 12/049,377 | 12/049,379 | 12/049,987 |
| 12/050,005 | 12/050,014 | 12/050,025 | 12/050,054 | 12/050,067 | 12/050,080 |
| 12/050,101 | 12/106,326 | 12/036,904 | 11/856,061 | 11/856,062 | 11/856,064 |
| 11/856,066 | 11/672,522 | 11/672,950 | 11/672,947 | 11/672,891 | 11/672,954 |
| 11/672,533 | 11/754,310 | 11/754,321 | 11/754,320 | 11/754,319 | 11/754,318 |
| 11/754,317 | 11/754,316 | 11/754,315 | 11/754,314 | 11/754,313 | 11/754,312 |

-continued

| | | | | | |
|---|---|---|---|---|---|
| 11/754,311 | 12/015,507 | 12/015,508 | 12/015,509 | 12/015,510 | 12/015,511 |
| 12/015,512 | 12/015,513 | 6,593,166 | 7,132,679 | 6,940,088 | 7,119,357 |
| 7,307,272 | 6,755,513 | 6,974,204 | 6,409,323 | 7,055,930 | 6,281,912 |
| 6,893,109 | 6,604,810 | 6,824,242 | 6,318,920 | 7,210,867 | 6,488,422 |
| 6,655,786 | 6,457,810 | 6,485,135 | 6,796,731 | 6,904,678 | 6,641,253 |
| 7,125,106 | 6,786,658 | 7,097,273 | 6,824,245 | 7,222,947 | 6,918,649 |
| 6,860,581 | 6,929,351 | 7,063,404 | 6,969,150 | 7,004,652 | 6,871,938 |
| 6,905,194 | 6,846,059 | 6,997,626 | 7,303,256 | 7,029,098 | 6,966,625 |
| 7,114,794 | 7,207,646 | 7,077,496 | 7,284,831 | 7,357,484 | 7,152,938 |
| 7,182,434 | 7,182,430 | 7,306,317 | 7,032,993 | 7,325,905 | 7,407,259 |
| 7,357,475 | 7,172,266 | 7,258,430 | 7,128,392 | 7,210,866 | 7,306,322 |
| 11/505,933 | 7,384,127 | 11/635,480 | 7,354,208 | 11/706,303 | 11/709,084 |
| 7,357,583 | 11/744,143 | 11/779,845 | 11/782,589 | 11/863,256 | 11/940,302 |
| 11/940,235 | 11/955,359 | 12/019,583 | 12/019,566 | 12/036,910 | 12/043,795 |
| 11/066,161 | 7,341,330 | 7,372,145 | 11/066,158 | 7,287,831 | 11/875,936 |
| 12/017,818 | 6,804,030 | 6,807,315 | 6,771,811 | 6,683,996 | 7,271,936 |
| 7,304,771 | 6,965,691 | 7,058,219 | 7,289,681 | 7,187,807 | 7,181,063 |
| 7,366,351 | 11/603,823 | 7,349,572 | 12/025,633 | 10/727,181 | 10/727,162 |
| 7,377,608 | 7,399,043 | 7,121,639 | 7,165,824 | 7,152,942 | 10/727,157 |
| 7,181,572 | 7,096,137 | 7,302,592 | 7,278,034 | 7,188,282 | 10/727,159 |
| 10/727,180 | 10/727,179 | 10/727,192 | 10/727,274 | 10/727,164 | 10/727,161 |
| 10/727,198 | 10/727,158 | 10/754,536 | 10/754,938 | 10/727,160 | 10/934,720 |
| 7,171,323 | 7,278,697 | 11/442,131 | 7,360,131 | 11/488,853 | 7,328,115 |
| 11/749,750 | 11/749,749 | 11/955,127 | 11/951,213 | 12/050,941 | 12/043,844 |
| 12/047,315 | 7,369,270 | 6,795,215 | 7,070,098 | 7,154,638 | 6,805,419 |
| 6,859,289 | 6,977,751 | 6,398,332 | 6,394,573 | 6,622,923 | 6,747,760 |
| 6,921,144 | 10/884,881 | 7,092,112 | 7,192,106 | 11/039,866 | 7,173,739 |
| 6,986,560 | 7,008,033 | 11/148,237 | 7,222,780 | 7,270,391 | 7,150,510 |
| 11/478,599 | 7,388,689 | 7,407,247 | 7,398,916 | 11/482,981 | 11/743,662 |
| 11/743,661 | 11/743,659 | 11/743,655 | 11/743,657 | 11/752,900 | 11/926,109 |
| 11/927,163 | 11/929,567 | 7,195,328 | 7,182,422 | 11/650,537 | 11/712,540 |
| 7,374,266 | 10/854,522 | 10/854,488 | 7,281,330 | 10/854,503 | 7,328,956 |
| 10/854,509 | 7,188,928 | 7,093,989 | 7,377,609 | 10/854,495 | 10/854,498 |
| 10/854,511 | 7,390,071 | 10/854,525 | 10/854,526 | 10/854,516 | 7,252,353 |
| 10/854,515 | 7,267,417 | 10/854,505 | 10/854,493 | 7,275,805 | 7,314,261 |
| 10/854,490 | 7,281,777 | 7,290,852 | 10/854,528 | 10/854,523 | 10/854,527 |
| 10/854,524 | 10/854,520 | 10/854,514 | 10/854,519 | 10/854,513 | 10/854,499 |
| 10/854,501 | 7,266,661 | 7,243,193 | 10/854,518 | 10/854,517 | 10/934,628 |
| 7,163,345 | 7,322,666 | 11/601,757 | 11/706,295 | 11/735,881 | 11/748,483 |
| 11/749,123 | 11/766,061 | 11/775,135 | 11/772,235 | 11/778,569 | 11/829,942 |
| 11/870,342 | 11/935,274 | 11/937,239 | 11/961,907 | 11/961,940 | 11/961,961 |
| 12/055,314 | 11/014,731 | D529081 | D541848 | D528597 | 6,924,907 |
| 6,712,452 | 6,416,160 | 6,238,043 | 6,958,826 | 6,812,972 | 6,553,459 |
| 6,967,741 | 6,956,669 | 6,903,766 | 6,804,026 | 7,259,889 | 6,975,429 |
| 10/636,234 | 10/636,233 | 7,301,567 | 10/636,216 | 7,274,485 | 7,139,084 |
| 7,173,735 | 7,068,394 | 7,286,182 | 7,086,644 | 7,250,977 | 7,146,281 |
| 7,023,567 | 7,136,183 | 7,083,254 | 6,796,651 | 7,061,643 | 7,057,758 |
| 6,894,810 | 6,995,871 | 7,085,010 | 7,092,126 | 7,123,382 | 7,061,650 |
| 10/853,143 | 6,986,573 | 6,974,212 | 7,307,756 | 7,173,737 | 10/954,168 |
| 7,246,868 | 7,399,076 | 7,137,699 | 11/107,798 | 7,148,994 | 7,077,497 |
| 11/176,372 | 7,248,376 | 11/225,158 | 7,306,321 | 7,173,729 | 7,372,601 |
| 11/478,607 | 11/503,085 | 11/545,502 | 11/583,943 | 11/585,946 | 11/653,239 |
| 7,385,713 | 11/764,781 | 11/764,782 | 11/779,884 | 11/845,666 | 11/872,637 |
| 11/944,401 | 11/940,215 | 11/544,764 | 11/544,765 | 11/544,772 | 11/544,773 |
| 11/544,774 | 11/544,775 | 11/544,776 | 11/544,766 | 11/544,767 | 7,384,128 |
| 11/544,770 | 11/544,769 | 11/544,777 | 11/544,768 | 11/544,763 | 11/293,804 |
| 11/293,840 | 11/293,803 | 11/293,833 | 11/293,834 | 11/293,835 | 11/293,836 |
| 11/293,837 | 11/293,792 | 11/293,794 | 11/293,839 | 11/293,826 | 11/293,829 |
| 11/293,830 | 11/293,827 | 11/293,828 | 7,270,494 | 11/293,823 | 11/293,824 |
| 11/293,831 | 11/293,815 | 11/293,819 | 11/293,818 | 11/293,817 | 11/293,816 |
| 11/838,875 | 11/482,978 | 11/640,356 | 11/640,357 | 11/640,358 | 11/640,359 |
| 11/640,360 | 11/640,355 | 11/679,786 | 11/872,714 | 10/760,254 | 10/760,210 |
| 7,364,263 | 7,201,468 | 7,360,868 | 10/760,249 | 7,234,802 | 7,303,255 |
| 7,287,846 | 7,156,511 | 10/760,264 | 7,258,432 | 7,097,291 | 10/760,222 |
| 10/760,248 | 7,083,273 | 7,367,647 | 7,374,355 | 10/760,204 | 10/760,205 |
| 10/760,206 | 10/760,267 | 10/760,270 | 7,198,352 | 7,364,264 | 7,303,251 |
| 7,201,470 | 7,121,655 | 7,293,861 | 7,232,208 | 7,328,985 | 7,344,232 |
| 7,083,272 | 7,261,400 | 11/474,272 | 11/474,315 | 7,311,387 | 11/583,874 |
| 7,303,258 | 11/706,322 | 11/706,968 | 11/749,119 | 11/749,157 | 11/779,848 |
| 11/782,590 | 11/855,152 | 11/855,151 | 11/870,327 | 11/934,780 | 11/935,992 |
| 11/951,193 | 12/017,327 | 12/015,273 | 12/036,882 | 12/050,164 | 12/050,166 |
| 11/014,764 | 11/014,763 | 7,331,663 | 7,360,861 | 7,328,973 | 11/014,760 |
| 7,407,262 | 7,303,252 | 7,249,822 | 11/014,762 | 7,311,382 | 7,360,860 |
| 7,364,257 | 7,390,075 | 7,350,896 | 11/014,758 | 7,384,135 | 7,331,660 |
| 11/014,738 | 11/014,737 | 7,322,684 | 7,322,685 | 7,311,381 | 7,270,405 |
| 7,303,268 | 11/014,735 | 7,399,072 | 7,393,076 | 11/014,750 | 11/014,749 |
| 7,249,833 | 11/758,640 | 11/775,143 | 11/838,877 | 11/944,453 | 11/944,633 |
| 11/955,065 | 12/003,875 | 12/003,952 | 12/007,818 | 12/007,817 | 12/068,679 |
| 12/071,187 | 12/076,665 | 12/079,897 | 11/014,769 | 11/014,729 | 7,331,661 |

-continued

| | | | | | |
|---|---|---|---|---|---|
| 11/014,733 | 7,300,140 | 7,357,492 | 7,357,493 | 11/014,766 | 7,380,902 |
| 7,284,816 | 7,284,845 | 7,255,430 | 7,390,080 | 7,328,984 | 7,350,913 |
| 7,322,671 | 7,380,910 | 11/014,717 | 11/014,716 | 11/014,732 | 7,347,534 |
| 11/097,268 | 11/097,185 | 7,367,650 | 11/778,567 | 11/852,958 | 11/852,907 |
| 11/872,038 | 11/955,093 | 11/961,578 | 12/022,023 | 12/023,000 | 12/023,018 |
| 12/031,582 | 12/043,708 | 11/293,820 | 11/293,813 | 11/293,822 | 11/293,812 |
| 7,357,496 | 11/293,814 | 11/293,793 | 11/293,842 | 11/293,811 | 11/293,807 |
| 11/293,806 | 11/293,805 | 11/293,810 | 12/050,021 | 11/688,863 | 11/688,864 |
| 11/688,865 | 7,364,265 | 11/688,867 | 11/688,868 | 11/688,869 | 11/688,871 |
| 11/688,872 | 11/688,873 | 11/741,766 | 12/014,767 | 12/014,768 | 12/014,769 |
| 12/014,770 | 12/014,771 | 12/014,772 | 12/014,773 | 12/014,774 | 12/014,775 |
| 12/014,776 | 12/014,777 | 12/014,778 | 12/014,779 | 12/014,780 | 12/014,781 |
| 12/014,782 | 12/014,783 | 12/014,784 | 12/014,785 | 12/014,787 | 12/014,788 |
| 12/014,789 | 12/014,790 | 12/014,791 | 12/014,792 | 12/014,793 | 12/014,794 |
| 12/014,796 | 12/014,798 | 12/014,801 | 12/014,803 | 12/014,804 | 12/014,805 |
| 12/014,806 | 12/014,807 | 12/049,371 | 12/049,372 | 12/049,373 | 12/049,374 |
| 12/049,375 | 61/034,147 | 11/482,982 | 11/482,983 | 11/482,984 | 11/495,818 |
| 11/495,819 | 11/677,049 | 11/677,050 | 11/677,051 | 11/872,719 | 11/872,718 |
| 12/046,449 | 61/033,357 | 7,306,320 | 11/934,781 | D528156 | 10/760,180 |
| 7,111,935 | 10/760,213 | 10/760,219 | 10/760,237 | 7,261,482 | 10/760,220 |
| 7,002,664 | 10/760,252 | 10/760,265 | 7,088,420 | 11/446,233 | 11/503,083 |
| 11/503,081 | 11/516,487 | 11/599,312 | 6,364,451 | 6,533,390 | 6,454,378 |
| 7,224,478 | 6,559,969 | 6,896,362 | 7,057,760 | 6,982,799 | 11/202,107 |
| 11/743,672 | 11/744,126 | 11/743,673 | 7,093,494 | 7,143,652 | 7,089,797 |
| 7,159,467 | 7,234,357 | 7,124,643 | 7,121,145 | 7,089,790 | 7,194,901 |
| 6,968,744 | 7,089,798 | 7,240,560 | 7,137,302 | 7,350,417 | 7,171,855 |
| 7,260,995 | 7,260,993 | 7,165,460 | 7,222,538 | 7,258,019 | 11/543,047 |
| 7,258,020 | 7,367,235 | 7,334,480 | 7,380,460 | 11/707,056 | 11/744,211 |
| 11/767,526 | 11/779,846 | 11/764,227 | 11/829,943 | 11/829,944 | 12/015,390 |
| 12/031,475 | 12/056,274 | 6,454,482 | 6,808,330 | 6,527,365 | 6,474,773 |
| 6,550,997 | 7,093,923 | 6,957,923 | 7,131,724 | 7,396,177 | 7,168,867 |
| 7,125,098 | 7,396,178 | 11/185,722 | 7,249,901 | 7,188,930 | 7,377,635 |
| 11/014,727 | D536031 | D531214 | 7,237,888 | 7,168,654 | 7,201,272 |
| 6,991,098 | 7,217,051 | 6,944,970 | 10/760,215 | 7,108,434 | 10/760,257 |
| 7,210,407 | 7,186,042 | 10/760,266 | 6,920,704 | 7,217,049 | 10/760,214 |
| 10/760,260 | 7,147,102 | 7,287,828 | 7,249,838 | 10/760,241 | 10/962,413 |
| 10/962,427 | 7,261,477 | 7,225,739 | 10/962,402 | 10/962,425 | 10/962,428 |
| 7,191,978 | 10/962,426 | 10/962,409 | 10/962,417 | 10/962,403 | 7,163,287 |
| 7,258,415 | 7,322,677 | 7,258,424 | 10/962,410 | 7,195,412 | 7,207,670 |
| 7,270,401 | 7,220,072 | 11/474,267 | 11/544,547 | 11/585,925 | 11/593,000 |
| 11/706,298 | 11/706,296 | 7,384,206 | 11/730,760 | 11/730,407 | 11/730,787 |
| 11/735,977 | 11/736,527 | 7,367,267 | 11/754,359 | 11/778,061 | 11/765,398 |
| 11/778,556 | 11/829,937 | 7,399,065 | 11/866,399 | 12/050,157 | 11/223,262 |
| 11/223,018 | 11/223,114 | 11/955,366 | 7,322,761 | 11/223,021 | 11/223,020 |
| 11/223,019 | 11/014,730 | D541849 | 29/279,123 | 6,716,666 | 6,949,217 |
| 6,750,083 | 7,014,451 | 6,777,259 | 6,923,524 | 6,557,978 | 6,991,207 |
| 6,766,998 | 6,967,354 | 6,759,723 | 6,870,259 | 10/853,270 | 6,925,875 |
| 10/898,214 | 7,095,109 | 7,145,696 | 10/976,081 | 7,193,482 | 7,134,739 |
| 7,222,939 | 7,164,501 | 7,118,186 | 7,201,523 | 7,226,159 | 7,249,839 |
| 7,108,343 | 7,154,626 | 7,079,292 | 10/980,184 | 7,233,421 | 7,063,408 |
| 7,377,706 | 10/982,804 | 7,032,996 | 10/982,834 | 10/982,833 | 7,349,216 |
| 7,217,046 | 6,948,870 | 7,195,336 | 7,070,257 | 10/986,813 | 10/986,785 |
| 7,093,922 | 6,988,789 | 7,371,024 | 7,246,871 | 10/992,748 | 10/992,747 |
| 7,187,468 | 10/992,828 | 7,196,814 | 7,372,593 | 7,268,911 | 7,265,869 |
| 7,128,384 | 7,164,505 | 7,284,805 | 7,025,434 | 7,298,519 | 7,280,244 |
| 7,206,098 | 7,265,877 | 7,193,743 | 7,168,777 | 11/006,734 | 7,195,329 |
| 7,198,346 | 7,281,786 | 11/013,363 | 11/013,881 | 6,959,983 | 7,128,386 |
| 7,097,104 | 7,350,889 | 7,083,261 | 7,070,258 | 7,083,275 | 7,110,139 |
| 6,994,419 | 6,935,725 | 7,398,597 | 7,178,892 | 7,219,429 | 6,988,784 |
| 11/026,135 | 7,289,156 | 7,407,614 | 7,284,976 | 7,178,903 | 7,273,274 |
| 7,083,256 | 7,325,986 | 7,278,707 | 7,325,918 | 6,974,206 | 7,364,258 |
| 7,066,588 | 7,222,940 | 11/075,918 | 7,018,025 | 7,221,867 | 7,290,863 |
| 7,188,938 | 7,021,742 | 7,083,262 | 7,192,119 | 11/083,021 | 7,036,912 |
| 7,175,256 | 7,182,441 | 7,083,258 | 7,114,796 | 7,147,302 | 7,380,906 |
| 7,219,982 | 7,118,195 | 7,229,153 | 6,991,318 | 7,108,346 | 11/248,429 |
| 7,404,617 | 7,178,899 | 7,066,579 | 11/281,419 | 7,370,947 | 11/329,188 |
| 11/329,140 | 7,270,397 | 7,258,425 | 7,237,874 | 7,152,961 | 7,333,235 |
| 7,207,658 | 11/484,744 | 7,311,257 | 7,207,659 | 11/525,857 | 11/540,569 |
| 11/583,869 | 7,400,419 | 11/585,947 | 7,306,307 | 11/604,316 | 11/604,309 |
| 11/604,303 | 11/643,844 | 7,329,061 | 11/655,940 | 11/653,320 | 7,278,713 |
| 7,391,531 | 11/706,323 | 11/706,963 | 11/713,660 | 7,290,853 | 11/696,186 |
| 11/730,390 | 11/737,139 | 11/737,749 | 7,387,365 | 11/749,122 | 11/754,361 |
| 11/766,043 | 11/764,775 | 11/768,872 | 11/775,156 | 11/779,271 | 7,401,902 |
| 11/829,938 | 11/839,502 | 11/858,852 | 11/862,188 | 11/859,790 | 11/872,618 |
| 11/923,651 | 11/950,255 | 11/930,001 | 11/955,362 | 12/015,368 | 11/965,718 |
| 12/049,975 | 12/050,946 | 6,485,123 | 6,425,657 | 6,488,358 | 7,021,746 |
| 6,712,986 | 6,981,757 | 6,505,912 | 6,439,694 | 6,364,461 | 6,378,990 |
| 6,425,658 | 6,488,361 | 6,814,429 | 6,471,336 | 6,457,813 | 6,540,331 |
| 6,454,396 | 6,464,325 | 6,443,559 | 6,435,664 | 6,412,914 | 6,488,360 |

-continued

| | | | | | |
|---|---|---|---|---|---|
| 6,550,896 | 6,439,695 | 6,447,100 | 7,381,340 | 6,488,359 | 6,637,873 |
| 10/485,738 | 6,618,117 | 10/485,737 | 6,803,989 | 7,234,801 | 7,044,589 |
| 7,163,273 | 6,416,154 | 6,547,364 | 10/485,744 | 6,644,771 | 7,152,939 |
| 6,565,181 | 7,325,897 | 6,857,719 | 7,255,414 | 6,702,417 | 7,284,843 |
| 6,918,654 | 7,070,265 | 6,616,271 | 6,652,078 | 6,503,408 | 6,607,263 |
| 7,111,924 | 6,623,108 | 6,698,867 | 6,488,362 | 6,625,874 | 6,921,153 |
| 7,198,356 | 6,536,874 | 6,425,651 | 6,435,667 | 10/509,997 | 6,527,374 |
| 7,334,873 | 6,582,059 | 10/510,152 | 6,513,908 | 7,246,883 | 6,540,332 |
| 6,547,368 | 7,070,256 | 6,508,546 | 10/510,151 | 6,679,584 | 7,303,254 |
| 6,857,724 | 10/509,998 | 6,652,052 | 10/509,999 | 6,672,706 | 10/510,096 |
| 6,688,719 | 6,712,924 | 6,588,886 | 7,077,508 | 7,207,654 | 6,935,724 |
| 6,927,786 | 6,988,787 | 6,899,415 | 6,672,708 | 6,644,767 | 6,874,866 |
| 6,830,316 | 6,994,420 | 6,954,254 | 7,086,720 | 7,240,992 | 7,267,424 |
| 7,128,397 | 7,084,951 | 7,156,496 | 7,066,578 | 7,101,023 | 11/165,027 |
| 11/202,235 | 7,399,063 | 7,159,965 | 7,255,424 | 11/349,519 | 7,137,686 |
| 7,201,472 | 7,287,829 | 11/504,602 | 7,216,957 | 11/520,572 | 11/583,858 |
| 11/583,895 | 11/585,976 | 11/635,488 | 7,278,712 | 11/706,952 | 11/706,307 |
| 7,287,827 | 11/944,451 | 11/740,287 | 7,364,271 | 11/758,643 | 11/778,572 |
| 11/859,791 | 11/863,260 | 11/874,178 | 11/936,064 | 11/951,983 | 12/015,483 |
| 12/050,938 | 6,916,082 | 6,786,570 | 7,407,261 | 6,848,780 | 6,966,633 |
| 7,179,395 | 6,969,153 | 6,979,075 | 7,132,056 | 6,832,828 | 6,860,590 |
| 6,905,620 | 6,786,574 | 6,824,252 | 7,097,282 | 6,997,545 | 6,971,734 |
| 6,918,652 | 6,978,990 | 6,863,105 | 10/780,624 | 7,194,629 | 10/791,792 |
| 6,890,059 | 6,988,785 | 6,830,315 | 7,246,881 | 7,125,102 | 7,028,474 |
| 7,066,575 | 6,986,202 | 7,044,584 | 7,210,762 | 7,032,992 | 7,140,720 |
| 7,207,656 | 7,285,170 | 11/048,748 | 7,008,041 | 7,011,390 | 7,048,868 |
| 7,014,785 | 7,131,717 | 7,284,826 | 7,331,101 | 7,182,436 | 7,104,631 |
| 7,240,993 | 7,290,859 | 11/202,217 | 7,172,265 | 7,284,837 | 7,066,573 |
| 7,364,270 | 7,152,949 | 7,334,877 | 7,380,913 | 7,326,357 | 7,156,492 |
| 11/478,588 | 7,331,653 | 7,287,834 | 11/525,861 | 11/583,939 | 11/545,504 |
| 7,284,326 | 11/635,485 | 11/730,391 | 11/730,788 | 11/749,148 | 11/749,149 |
| 11/749,152 | 11/749,151 | 11/759,886 | 11/865,668 | 11/874,168 | 11/874,203 |
| 11/971,182 | 12/021,086 | 12/015,441 | 11/965,722 | 6,824,257 | 7,270,475 |
| 6,971,811 | 6,878,564 | 6,921,145 | 6,890,052 | 7,021,747 | 6,929,345 |
| 6,811,242 | 6,916,087 | 6,905,195 | 6,899,416 | 6,883,906 | 6,955,428 |
| 7,284,834 | 6,932,459 | 6,962,410 | 7,033,008 | 6,962,409 | 7,013,641 |
| 7,204,580 | 7,032,997 | 6,998,278 | 7,004,563 | 6,910,755 | 6,969,142 |
| 6,938,994 | 7,188,935 | 7,380,339 | 7,134,740 | 6,997,537 | 7,004,567 |
| 6,916,091 | 7,077,588 | 6,918,707 | 6,923,583 | 6,953,295 | 6,921,221 |
| 7,001,008 | 7,168,167 | 7,210,759 | 7,337,532 | 7,331,659 | 7,322,680 |
| 6,988,790 | 7,192,120 | 7,168,789 | 7,004,577 | 7,052,120 | 6,994,426 |
| 7,258,418 | 7,014,298 | 7,328,977 | 7,370,941 | 7,152,955 | 7,097,292 |
| 7,207,657 | 7,152,944 | 7,147,303 | 7,338,147 | 7,134,608 | 7,264,333 |
| 7,093,921 | 7,077,590 | 7,147,297 | 7,377,621 | 7,387,363 | 7,380,908 |
| 7,387,573 | 7,077,507 | 7,172,672 | 7,175,776 | 7,086,717 | 7,101,020 |
| 7,347,535 | 7,201,466 | 7,404,620 | 7,152,967 | 7,182,431 | 7,210,666 |
| 7,252,367 | 7,287,837 | 11/485,255 | 7,374,695 | 6,945,630 | 7,018,294 |
| 6,910,014 | 6,659,447 | 6,648,321 | 7,082,980 | 6,672,584 | 7,073,551 |
| 6,830,395 | 7,289,727 | 7,001,011 | 6,880,922 | 6,886,915 | 6,644,787 |
| 6,641,255 | 7,066,580 | 6,652,082 | 7,284,833 | 6,666,544 | 6,666,543 |
| 6,669,332 | 6,984,023 | 6,733,104 | 6,644,793 | 6,723,575 | 6,953,235 |
| 6,663,225 | 7,076,872 | 7,059,706 | 7,185,971 | 7,090,335 | 6,854,827 |
| 6,793,974 | 10/636,258 | 7,222,929 | 6,739,701 | 7,073,881 | 7,155,823 |
| 7,219,427 | 7,008,503 | 6,783,216 | 6,883,890 | 6,857,726 | 7,347,952 |
| 6,641,256 | 6,808,253 | 6,827,428 | 6,802,587 | 6,997,534 | 6,959,982 |
| 6,959,981 | 6,886,917 | 6,969,473 | 6,827,425 | 7,007,859 | 6,802,594 |
| 6,792,754 | 6,860,107 | 6,786,043 | 6,863,378 | 7,052,114 | 7,001,007 |
| 10/729,151 | 10/729,157 | 6,948,794 | 6,805,435 | 6,733,116 | 7,391,435 |
| 7,008,046 | 6,880,918 | 7,066,574 | 6,983,595 | 6,923,527 | 7,275,800 |
| 7,163,276 | 7,156,495 | 6,976,751 | 6,994,430 | 7,014,296 | 7,059,704 |
| 7,160,743 | 7,175,775 | 7,287,839 | 7,097,283 | 7,140,722 | 11/123,009 |
| 11/123,008 | 7,080,893 | 7,093,920 | 7,270,492 | 7,128,093 | 7,052,113 |
| 7,055,934 | 7,367,729 | 7,278,796 | 11/159,197 | 7,083,263 | 7,145,592 |
| 7,025,436 | 11/281,444 | 7,258,421 | 7,396,108 | 7,332,051 | 7,226,147 |
| 11/482,940 | 7,195,339 | 11/503,061 | 11/505,938 | 7,284,838 | 7,293,856 |
| 7,350,901 | 11/540,576 | 7,325,901 | 11/592,991 | 11/599,342 | 11/600,803 |
| 11/604,321 | 11/604,302 | 11/635,535 | 11/635,486 | 11/643,842 | 7,347,536 |
| 7,380,580 | 11/706,301 | 11/707,039 | 11/730,388 | 11/730,786 | 11/730,785 |
| 7,370,942 | 7,322,679 | 11/768,875 | 11/779,847 | 11/829,940 | 11/847,240 |
| 11/834,625 | 11/863,210 | 11/865,680 | 11/874,156 | 11/923,602 | 11/951,940 |
| 11/954,988 | 11/961,662 | 12/015,178 | 12/015,157 | 12/017,305 | 12/017,926 |
| 12/015,261 | 12/025,605 | 12/049,961 | 12/031,646 | 7,067,067 | 6,776,476 |
| 6,880,914 | 7,086,709 | 6,783,217 | 7,147,791 | 6,929,352 | 7,144,095 |
| 6,820,974 | 6,918,647 | 6,984,016 | 7,192,125 | 6,824,251 | 6,834,939 |
| 6,840,600 | 6,786,573 | 7,144,519 | 6,799,835 | 6,959,975 | 6,959,974 |
| 7,021,740 | 6,935,718 | 6,938,983 | 6,938,991 | 7,226,145 | 7,140,719 |
| 6,988,788 | 7,022,250 | 6,929,350 | 7,011,393 | 7,004,566 | 7,175,097 |
| 6,948,799 | 7,143,944 | 7,310,157 | 7,029,100 | 6,957,811 | 7,073,724 |
| 7,055,933 | 7,077,490 | 7,055,940 | 10/991,402 | 7,234,645 | 7,032,999 |

-continued

| | | | | | |
|---|---|---|---|---|---|
| 7,066,576 | 7,229,150 | 7,086,728 | 7,246,879 | 7,284,825 | 7,140,718 |
| 7,284,817 | 7,144,098 | 7,044,577 | 7,284,824 | 7,284,827 | 7,189,334 |
| 7,055,935 | 7,152,860 | 11/203,188 | 11/203,173 | 7,334,868 | 7,213,989 |
| 7,341,336 | 7,364,377 | 7,300,141 | 7,114,868 | 7,168,796 | 7,159,967 |
| 7,328,966 | 7,152,805 | 11/298,530 | 11/330,061 | 7,133,799 | 7,380,912 |
| 11/329,284 | 7,152,956 | 7,128,399 | 7,147,305 | 7,287,702 | 7,325,904 |
| 7,246,884 | 7,152,960 | 7,380,929 | 11/454,901 | 11/442,134 | 11/450,441 |
| 11/474,274 | 7,401,895 | 7,270,399 | 6,857,728 | 6,857,729 | 6,857,730 |
| 6,989,292 | 7,126,216 | 6,977,189 | 6,982,189 | 7,173,332 | 7,026,176 |
| 6,979,599 | 6,812,062 | 6,886,751 | 10/804,057 | 10/804,036 | 7,001,793 |
| 6,866,369 | 6,946,743 | 7,322,675 | 6,886,918 | 7,059,720 | 7,306,305 |
| 7,350,887 | 7,334,855 | 7,360,850 | 7,347,517 | 6,951,390 | 6,981,765 |
| 6,789,881 | 6,802,592 | 7,029,097 | 6,799,836 | 7,048,352 | 7,182,267 |
| 7,025,279 | 6,857,571 | 6,817,539 | 6,830,198 | 6,992,791 | 7,038,809 |
| 6,980,323 | 7,148,992 | 7,139,091 | 6,947,173 | 7,101,034 | 6,969,144 |
| 6,942,319 | 6,827,427 | 6,984,021 | 6,984,022 | 6,869,167 | 6,918,542 |
| 7,007,852 | 6,899,420 | 6,918,665 | 6,997,625 | 6,988,840 | 6,984,080 |
| 6,845,978 | 6,848,687 | 6,840,512 | 6,863,365 | 7,204,582 | 6,921,150 |
| 7,128,396 | 6,913,347 | 7,008,819 | 6,935,736 | 6,991,317 | 7,284,836 |
| 7,055,947 | 7,093,928 | 7,100,834 | 7,270,396 | 7,187,086 | 7,290,856 |
| 7,032,825 | 7,086,721 | 7,159,968 | 7,010,456 | 7,147,307 | 7,111,925 |
| 7,334,867 | 7,229,154 | 11/505,849 | 7,370,938 | 7,328,994 | 7,341,672 |
| 11/540,575 | 11/583,937 | 7,278,711 | 7,290,720 | 7,314,266 | 11/635,489 |
| 7,357,488 | 11/635,490 | 11/635,525 | 7,287,706 | 11/706,366 | 11/706,310 |
| 11/706,308 | 11/785,108 | 7,373,083 | 7,362,971 | 11/748,485 | 7,350,906 |
| 11/764,778 | 11/766,025 | 11/834,635 | 11/839,541 | 11/860,420 | 11/865,693 |
| 11/863,118 | 11/866,307 | 11/866,340 | 11/869,684 | 11/869,722 | 11/869,694 |
| 11/876,592 | 11/945,244 | 11/951,121 | 11/945,238 | 11/955,358 | 11/965,710 |
| 11/962,050 | 12/015,478 | 12/015,423 | 12/015,434 | 12/023,015 | 12/030,755 |
| 12/025,641 | 12/056,228 | 12/036,279 | 12/031,598 | 12/050,949 | 12/056,217 |
| 12/062,514 | 12/062,517 | 12/062,518 | 12/062,520 | 12/062,521 | 12/062,522 |
| 12/062,523 | 12/062,524 | 12/06,252 | 12/062,526 | 12/062,527 | 12/062,528 |
| 12/062,529 | 12/062,530 | 12/062,531 | | | |

BACKGROUND OF THE INVENTION

The Applicant has developed a wide range of printers that employ pagewidth printheads instead of traditional reciprocating printhead designs. Pagewidth designs increase print speeds as the printhead does not traverse back and forth across the page to deposit a line of an image. The pagewidth printhead simply deposits the ink on the media as it moves past at high speeds. Such printheads have made it possible to perform full colour 1600 dpi printing at speeds of around 60 pages per minute, speeds previously unattainable with conventional inkjet printers.

Printing at these speeds consumes ink quickly and this gives rise to problems with supplying ink to the printhead. Not only are the flow rates higher but distributing the ink along the entire length of a pagewidth printhead is more complex than feeding ink to a relatively small reciprocating printhead. In particular, the hydrostatic ink pressure requires careful control to avoid printhead flooding. The Applicant has previously described means for controlling hydrostatic ink pressure in an ink supply system for a pagewidth printhead (see U.S. application Ser. No. 11/677,049 filed Feb. 21, 2007 and U.S. application Ser. No. 11/872,714 filed Oct. 16, 2007, the contents of which are herein incorporated by reference).

Additionally, the Applicant's design of high speed A4 pagewidth printers requires periodic replacement of a printhead cartridge, which comprises the printhead. In order to replace a printhead cartridge, it is necessary to deprime a printhead, remove the printhead from the printer, replace the printhead with a new replacement printhead, and prime the replacement printhead once it is installed in the printer. Hence, the ink supply system must be able to perform prime and deprime operations efficiently and, preferably, with minimal ink wastage.

SUMMARY OF THE INVENTION

In a first aspect the present invention provides a printer comprising:

a printhead having an ink inlet and an ink outlet;

a pressure-regulating chamber containing ink at a predetermined first level relative to said printhead, said chamber comprising:

an outlet port;

a return port positioned in a base of the chamber;

a snorkel extending from said return port and terminating at a snorkel outlet positioned above said first level of ink; and an air vent open to atmosphere, said air vent communicating with a headspace above said ink;

an upstream ink line interconnecting said outlet port and said ink inlet; and a downstream ink line interconnecting said return port and said ink outlet, said downstream ink line having a section looping below said first level of ink, wherein, in a printing configuration, a second level of ink in said snorkel is equal to said first level of ink in said chamber.

Optionally, the printer comprising means for maintaining the predetermined first level of ink in said chamber, said predetermined first level of ink controlling a hydrostatic pressure of ink supplied to said ink inlet.

Optionally, said hydrostatic pressure, relative to atmospheric pressure, is defined as $\rho gh$, wherein $\rho$ is the density of ink, g is acceleration due to gravity and h is the height of the predetermined first level of ink relative to the printhead.

Optionally, said means for maintaining said predetermined first level of ink comprises an ink reservoir cooperating with a float valve contained in said pressure-regulating chamber.

Optionally, said float valve comprises:

an arm pivotally mounted about a pivot;

a float mounted at one end of said arm; and a valve stem attached to said arm, said valve stem having a valve head for closure of a valve seat, wherein said valve seat is positioned at an inlet port of said pressure-regulating chamber.

Optionally, the printer further comprising an ink reservoir in fluid communication with said inlet port.

Optionally, said float valve is biased towards a closed position by a positive ink pressure at said inlet port, said positive ink pressure being provided by said ink reservoir positioned above said chamber.

Optionally, the printer further comprising a printhead priming system.

Optionally, said priming system comprises an ink pump positioned in said downstream ink line.

Optionally, said pump is a peristaltic pump.

Optionally, in a priming configuration, said pump pumps ink from said outlet port towards said return port so as to prime said printhead.

Optionally, said pump is a reversible pump.

Optionally, in a de-priming configuration, said pump pumps ink from said return port towards said outlet port, so as to de-prime said printhead.

Optionally, said downstream ink line comprises inline filters positioned on either side of said pump.

Optionally, the printer further comprising a first air accumulator communicating with said downstream ink line, said first air accumulator being configured for dampening ink pressure pulses.

Optionally, said printhead comprises one or more second air accumulators communicating with ink channels in the printhead, said second air accumulators being configured for dampening ink pressure pulses.

Optionally, said one or more second air accumulators are configured for dampening relatively high frequency pressure pulses and said first air accumulator is configured for dampening relatively low frequency pressure pulses.

Optionally, said first air accumulator has a larger volume than each of said one or more second air accumulators.

Optionally, said printhead is removably replaceable in said printer.

Optionally, said printhead comprises an inlet coupling and an outlet coupling, said inlet coupling being detachably connected to a complementary upstream ink line coupling and said outlet coupling being detachably connected to a complementary downstream ink line coupling.

In a second aspect the present invention provides a pressure-regulating chamber for maintaining ink contained therein at a predetermined first level relative to a printhead, said chamber comprising:

an inlet port for connection to an ink reservoir via an ink supply line;

an outlet port for connection to an ink inlet of the printhead via an upstream ink line;

a return port for connection to an ink outlet of the printhead via a downstream ink line;

a snorkel extending from said return port and terminating at a snorkel outlet positioned above said first level of ink;

an air vent open to atmosphere, said air vent communicating with a headspace above said ink; and a float valve for maintaining said predetermined first level of ink by controlling a flow of ink into said inlet port.

Optionally, said float valve comprises:

an arm pivotally mounted about a pivot;

a float mounted at one end of said arm; and a valve stem attached to said arm, said valve stem having a valve head for closure of a valve seat, wherein said valve seat is positioned at the inlet port of said pressure-regulating chamber.

Optionally, said valve head comprises an umbrella cap for closure of the valve seat.

Optionally, an outer surface of a base of said chamber comprises said valve seat.

Optionally, said float valve is configured such that downward movement of said valve stem unseats said umbrella cap from said valve seat.

Optionally, a positive ink pressure at said inlet port urges said umbrella cap against said valve seat.

Optionally, the positive ink pressure is provided by an ink reservoir positioned above said chamber and in fluid communication with said inlet port.

Optionally, said valve stem is positioned between said pivot and said float.

Optionally, said inlet port and said outlet port are positioned towards a base of said chamber.

Optionally, said return port is positioned at a base of said chamber.

Optionally, said air vent comprises an air-permeable membrane, which is impervious to ink.

Optionally, the pressure-regulating chamber comprising a roof cavity, and wherein said snorkel has a snorkel outlet positioned in said roof cavity.

Optionally, said return port comprises an inline ink filter.

In a third aspect the present invention provides a printer comprising:

a printhead having an ink inlet and an ink outlet;

an ink chamber for supplying ink to said printhead, said chamber having an outlet port;

an upstream ink line interconnecting said outlet port and said ink inlet;

a downstream ink line connected to said ink outlet; and a first air accumulator communicating with said downstream ink line, said first air accumulator being configured for dampening ink pressure pulses in said printhead during printing.

Optionally, said printhead comprises one or more second air accumulators communicating with ink channels in the printhead, said second air accumulators being configured for dampening ink pressure pulses in said printhead during printing.

Optionally, said one or more second air accumulators are configured for dampening relatively high frequency pressure pulses and said first air accumulator is configured for dampening relatively low frequency pressure pulses.

Optionally, said first air accumulator has a larger volume than each of said one or more second air accumulators.

Optionally, said downstream ink line comprises an inline ink pump for priming and/or depriming said printhead.

Optionally, said first air accumulator is positioned between said ink outlet and said pump.

Optionally, said pump is a reversible peristaltic pump.

Optionally, said downstream ink line comprises inline filters positioned on either side of said pump.

Optionally, said downstream ink line interconnects said ink outlet and a return port in said chamber for recycling of ink into said chamber.

Optionally, said chamber comprises a snorkel extending from said return port to above a level of ink in said chamber.

Optionally, said chamber comprises an air vent open to atmosphere, said air vent communicating with a headspace above said ink so as to equalize a hydrostatic pressure in said upstream and downstream ink lines.

Optionally, said chamber is a pressure-regulating chamber for controlling a hydrostatic pressure of ink supplied to said printhead.

Optionally, said chamber comprises means for maintaining a predetermined first level of ink in said chamber relative to said printhead.

Optionally, said hydrostatic pressure, relative to atmospheric pressure, is defined as $\rho gh$, wherein $\rho$ is the density of ink, g is acceleration due to gravity and h is the height of the predetermined first level of ink relative to the printhead.

Optionally, said means for maintaining said predetermined first level of ink comprises an ink reservoir cooperating with a float valve contained in said pressure-regulating chamber.

Optionally, said float valve comprises:

an arm pivotally mounted about a pivot;

a float mounted at one end of said arm; and a valve stem attached to said arm, said valve stem having a valve head for closure of a valve seat, wherein said valve seat is positioned at an inlet port of said pressure-regulating chamber.

Optionally, said inlet port and said outlet port of said pressure-regulating chamber are positioned towards a base of said chamber.

Optionally, the printer further comprising an ink reservoir in fluid communication with said inlet port.

Optionally, said printhead is removably replaceable in said printer.

Optionally, said printhead comprises an inlet coupling and an outlet coupling, said inlet coupling being detachably connected to a complementary upstream ink line coupling and said outlet coupling being detachably connected to a complementary downstream ink line coupling.

In a fourth aspect the present invention provides a method of priming a printhead, said method comprising the steps of:

(i) providing a printhead having a plurality of nozzles for ejection of ink, an ink inlet and an ink outlet;

(ii) providing an ink chamber having an outlet port connected to said ink inlet via an upstream ink line, said ink chamber having an inlet port controlled by a valve;

(iii) priming said printhead by pumping ink from said ink chamber, through said printhead and into a downstream ink line connected to said ink outlet; and (iv) opening said valve if a level of ink in said chamber falls below a predetermined first level and replenishing with ink from an ink reservoir when said valve is open.

Optionally, said printhead is a pagewidth inkjet printhead.

Optionally, said valve is a float valve positioned in said chamber.

Optionally, said valve is opened when a float in said chamber falls below said predetermined first level.

Optionally, said float valve comprises:

an arm pivotally mounted about a pivot;

a float mounted at one end of said arm; and a valve stem attached to said arm, said valve stem having a valve head for closure of a valve seat, wherein said valve seat is positioned at the inlet port of said chamber.

Optionally, said chamber comprises an air vent open to atmosphere, said air vent communicating with a headspace above said ink.

Optionally, said pumping is by means of an inline ink pump.

Optionally, said ink pump is positioned in said downstream ink line.

Optionally, said ink pump is a peristaltic pump.

Optionally, said pump is reversible.

Optionally, ink is recycled from said downstream ink line back into said chamber during priming.

Optionally, said chamber comprises a return port connected to said downstream ink line, and a snorkel extending from said return port to above the ink in said chamber.

Optionally, said ink is filtered prior to being recycled back into said chamber.

Optionally, ink drains from said ink reservoir into said ink chamber under gravity.

Optionally, said ink chamber functions as a pressure-regulating chamber during normal printing, said chamber controlling a hydrostatic pressure of ink supplied to said printhead.

Optionally, said priming and said replenishment of ink occur concomitantly.

Optionally, said printhead comprises:

an ink distribution manifold having said ink inlet and said ink outlet; and one or more printhead integrated circuits mounted on said manifold, each printhead integrated circuit comprising a plurality of nozzles.

Optionally, said priming comprises filling said manifold with ink and priming said printhead integrated circuits by capillary action.

In a fifth aspect the present invention provides a method of depriming a printhead, said method comprising the steps of:

(i) providing a printhead having a plurality of nozzles for ejection of ink, an ink inlet and an ink outlet;

(ii) providing an ink chamber having an outlet port connected to said ink inlet via an upstream ink line, said ink chamber having an inlet port controlled by a valve;

(iii) depriming said printhead by pumping ink from a downstream ink line connected to said ink outlet, through said printhead and into said ink chamber; and (iv) closing said valve when a level of ink in said chamber reaches a predetermined first level, thereby isolating said ink chamber from an ink reservoir in fluid communication with said inlet port.

Optionally, said printhead is a pagewidth inkjet printhead.

Optionally, said valve is a float valve positioned in said chamber.

Optionally, said valve is closed when a float in said chamber reaches said predetermined first level.

Optionally, said float valve comprises:

an arm pivotally mounted about a pivot;

a float mounted at one end of said arm; and a valve stem attached to said arm, said valve stem having a valve head for closure of a valve seat, wherein said valve seat is positioned at the inlet port of said chamber.

Optionally, said chamber comprises an air vent open to atmosphere, said air vent communicating with a headspace above said ink.

Optionally, said pumping is by means of an inline ink pump.

Optionally, said ink pump is positioned in said downstream ink line.

Optionally, said ink pump is a peristaltic pump.

Optionally, said pump is reversible.

Optionally, said chamber comprises a return port connected to said downstream ink line, and a snorkel extending from said return port to above the ink in said chamber.

Optionally, said downstream ink line comprises inline filters positioned on either side of said pump.

Optionally, said ink chamber functions as a pressure-regulating chamber during normal printing, said chamber controlling a hydrostatic pressure of ink supplied to said printhead.

Optionally, said valve is configured to be closed for at least the duration of said depriming.

Optionally, the method further comprising the steps of:

(v) removing said deprimed printhead; and (vi) replacing said deprimed printhead with a replacement printhead.

Optionally, the method further comprising the step of:

(vii) priming said replacement printhead by pumping ink from said ink chamber, through said printhead and into said downstream ink line.

In a sixth aspect the present invention provides a pressure-regulating chamber for maintaining ink contained therein at a predetermined first level relative to a printhead, said chamber comprising:

an inlet port for connection to an ink reservoir via an ink supply line;

an outlet port for connection to an ink inlet of a printhead via an upstream ink line;

an air vent open to atmosphere, said air vent communicating with a headspace above said ink; and a float valve for maintaining said predetermined first level of ink by controlling a flow of ink into said inlet port, wherein said float valve is biased towards a closed position by a positive ink pressure at said inlet port.

Optionally, said float valve comprises:

an arm pivotally mounted about a pivot;

a float mounted at one end of said arm; and a valve stem attached to said arm, said valve stem having a valve head for closure of a valve seat, wherein said valve seat is positioned at the inlet port of said pressure-regulating chamber.

Optionally, said valve head comprises an umbrella sealing cap for closure of the valve seat.

Optionally, an outer surface of a base of said chamber comprises said valve seat.

Optionally, said float valve is configured such that downward movement of said valve stem towards said base unseats said umbrella cap from said valve seat.

Optionally, said positive ink pressure at said inlet port urges said umbrella sealing cap against said valve seat.

Optionally, the positive ink pressure is provided by said ink reservoir positioned above said chamber.

Optionally, said valve stem is positioned between said pivot and said float.

Optionally, said inlet port and said outlet port are positioned towards a base of said chamber.

Optionally, the pressure-regulating chamber comprising a return port positioned at a base of said chamber.

Optionally, the pressure-regulating chamber comprising a snorkel extending from said return port and terminating at a snorkel outlet positioned above said first level of ink;

Optionally, the pressure-regulating chamber comprising a roof cavity, and wherein said snorkel has a snorkel outlet positioned in said roof cavity.

Optionally, said air vent comprises an air-permeable membrane, which is impervious to ink.

Optionally, said return port comprises an inline ink filter.

DETAILED DESCRIPTION OF THE PREFERRED EMBODIMENT

Print Engine and Printhead Cartridge Overview

Figure 1:
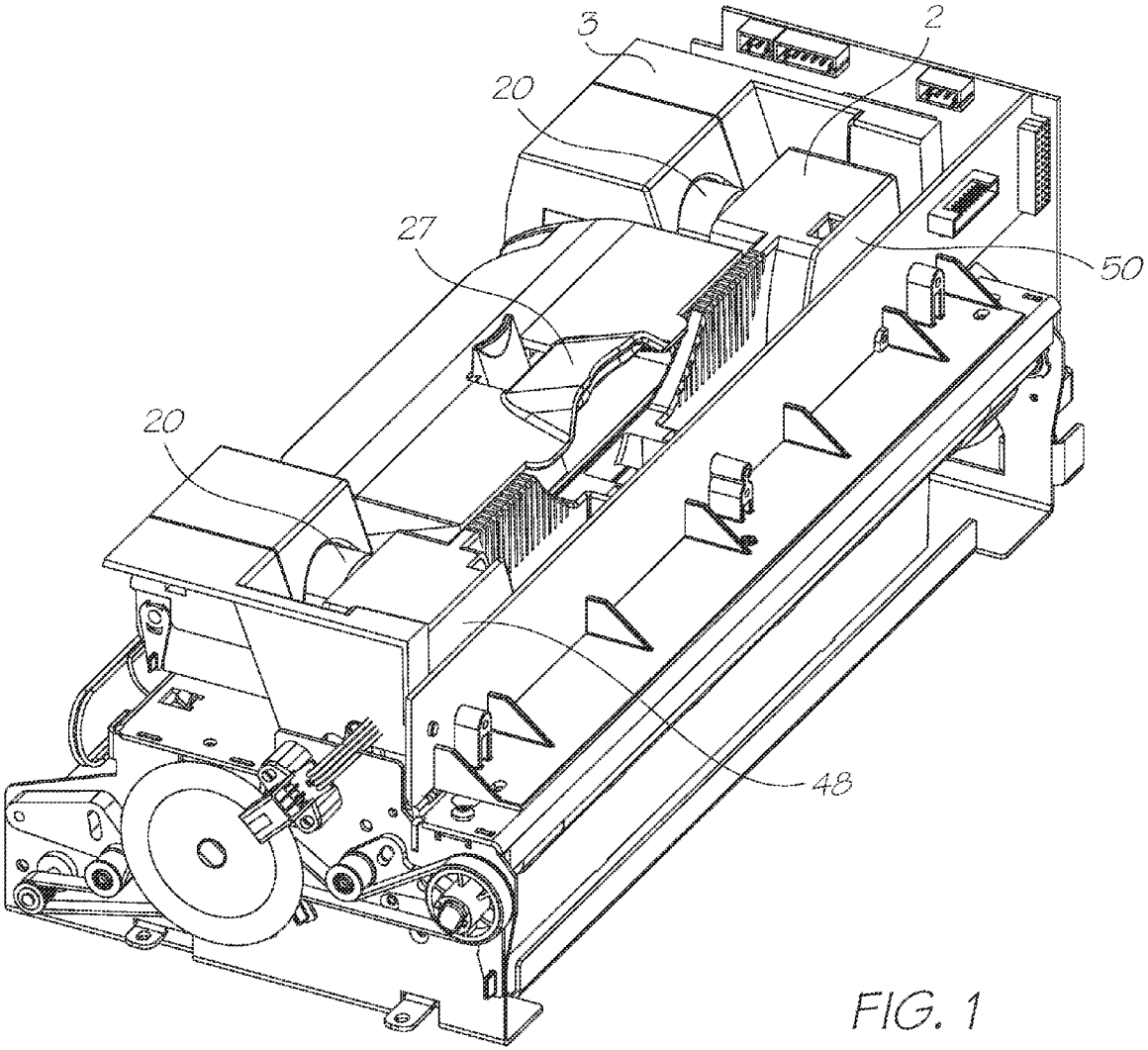
FIG. 1 shows a printhead cartridge installed in a print engine of a printer.
Figure 2:
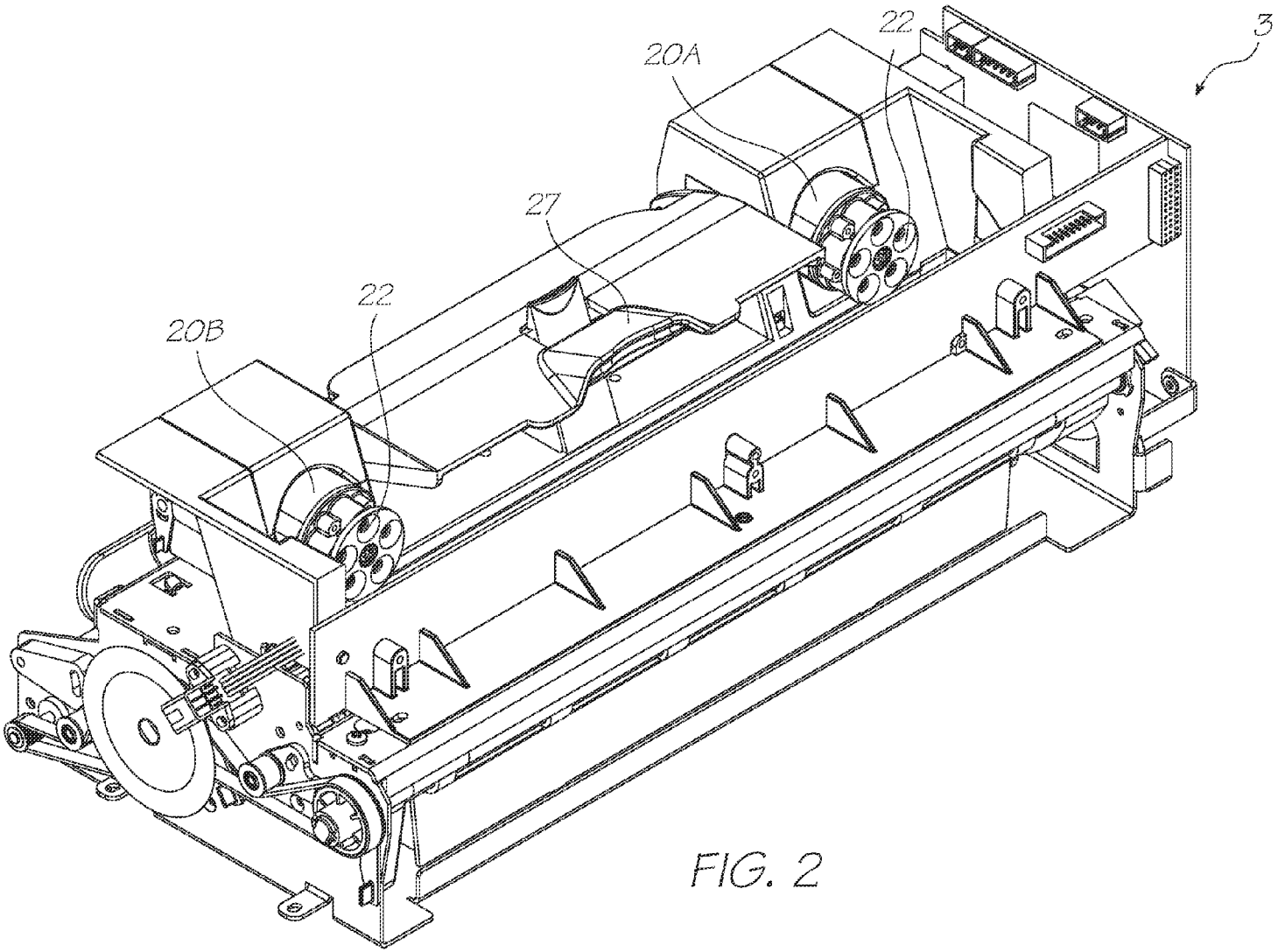
FIG. 2 shows the print engine without the printhead cartridge installed to expose inlet and outlet ink manifolds.

FIG. 1 shows a printhead cartridge 2 installed in a print engine 3. The print engine 3 is the mechanical heart of a printer which can have many different external casing shapes, ink tank locations and capacities, as well as media feed and collection trays. The printhead cartridge 2 can be inserted in and removed from the print engine 3 enabling periodic replacement. To remove the printhead cartridge 2, a user lifts a latch 27 and lifts the cartridge out from the print engine 3. FIG. 2 shows the print engine 3 with the printhead cartridge 2 removed.

When inserting the printhead cartridge 2 into the print engine 3, electrical and fluidic connections are made between the cartridge and the print engine. Contacts 33 on the printhead cartridge 2 (see FIG. 4) engage with complementary contacts (not shown) on the print engine 3. In addition, an ink inlet manifold 48 and an ink outlet manifold 50 on the printhead cartridge 2 mate with complementary sockets 20 on the print engine 3. The ink inlet manifold coupling 48 provides a plurality of ink inlets for the printhead cartridge 2, each corresponding to a different color channel. Likewise, the ink outlet manifold coupling 50 provides a plurality of ink outlets for the printhead cartridge 2, each corresponding to a different color channel. As will be explained in more detail below, the fluidics system of the present invention typically requires ink to flow through the printhead cartridge 2, from an ink inlet to an ink outlet, in order to achieve priming and depriming of the printhead.

Referring again to FIG. 2, with the printhead cartridge 2 removed, apertures 22 are revealed in each of the sockets 20. Each aperture 22 receives a complementary spout 52 and 54 on the inlet and outlet manifolds 48 and 50, respectively (see FIG. 5).

Ink is supplied to a rear of an inlet socket 20B from pressure-regulating chambers 106, which are usually mounted towards a base of the print engine 3 (see FIG. 19). The pressure-regulating chambers receive ink by gravity from ink tanks 128 mounted elsewhere on the print engine 3.

Ink exits from a rear of an outlet socket 20A, which is connected via conduits to a bubble-bursting box (not shown in FIG. 2). Details of the fluidic system and its components will be described in greater detail below.

Figure 3:
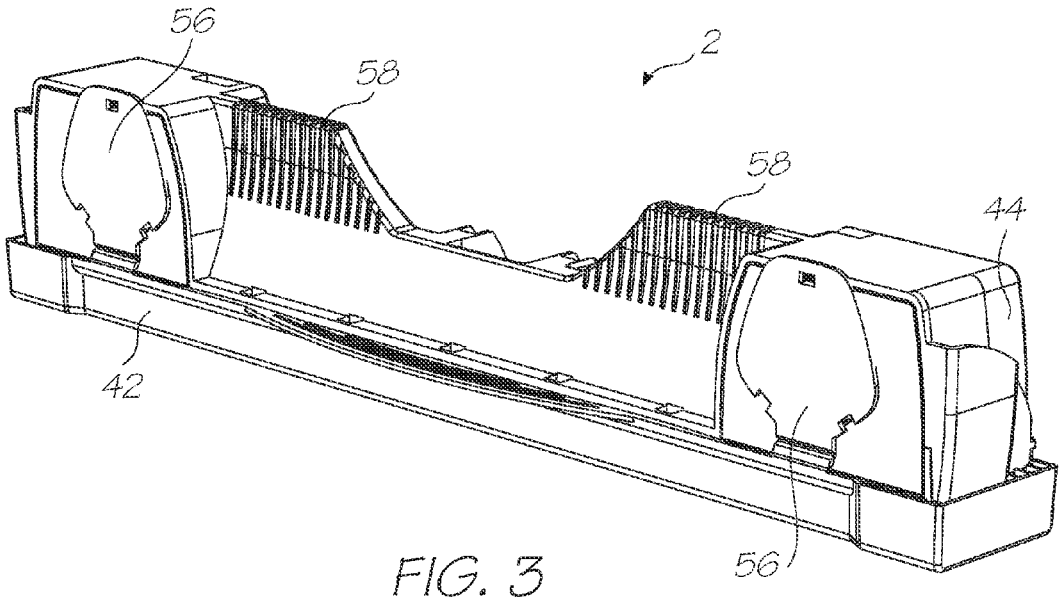
FIG. 3 is a perspective of the complete printhead cartridge.

FIG. 3 is a perspective of the complete printhead cartridge 2 removed from the print engine 3. The printhead cartridge 2 has a top molding 44 and a removable protective cover 42. The top molding 44 has a central web for structural stiffness and to provide textured grip surfaces 58 for manipulating the cartridge during insertion and removal. A base portion of the protective cover 42 protects printhead ICs 30 and the line of contacts 33 (see FIG. 4) prior to installation in the printer. Caps 56 are integrally formed with the base portion and cover ink inlet spouts 52 and outlet spouts 54 (see FIG. 5).

Figure 4:
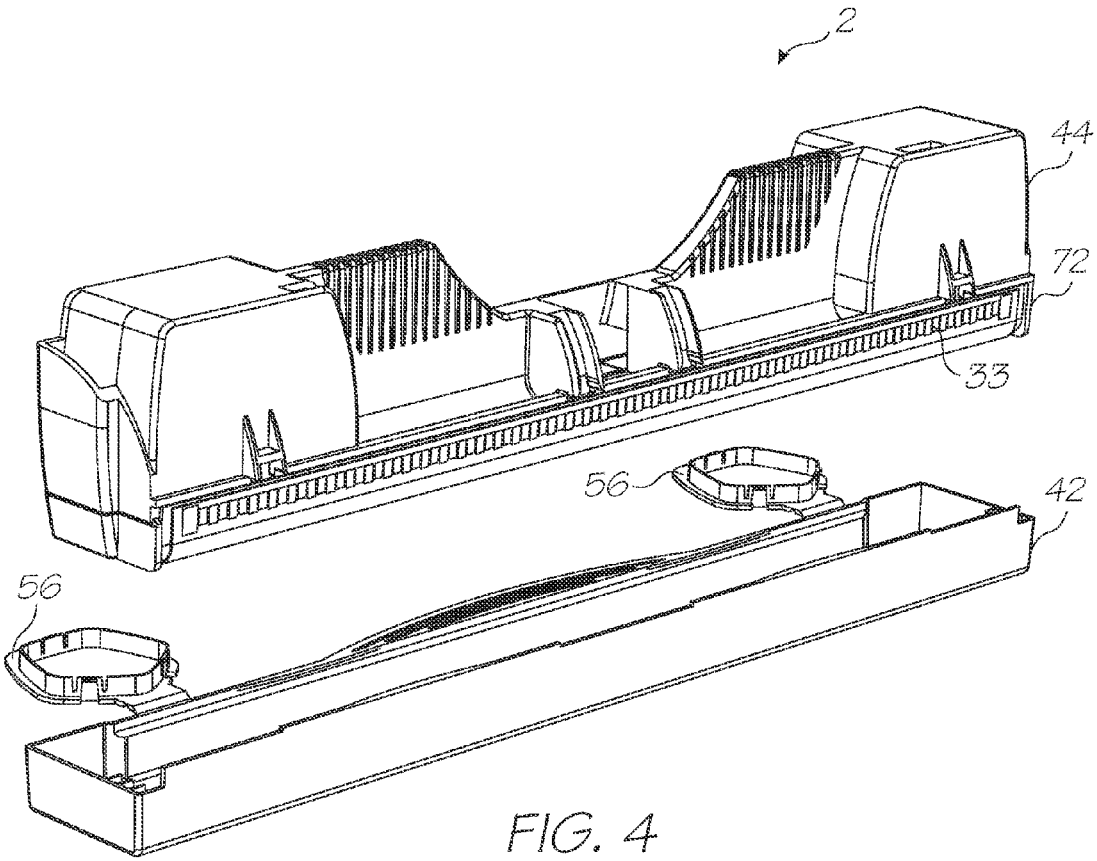
FIG. 4 shows the printhead cartridge of FIG. 3 with the protective cover removed.

FIG. 4 shows the printhead cartridge 2 with its protective cover 42 removed to expose printhead ICs (not shown in FIG. 4) on a bottom surface and the line of contacts 33 on a side surface of the printhead cartridge. The protective cover 42 may be either discarded or fitted to a printhead cartridge being replaced so as to contain any leakage from residual ink.

Figure 5:
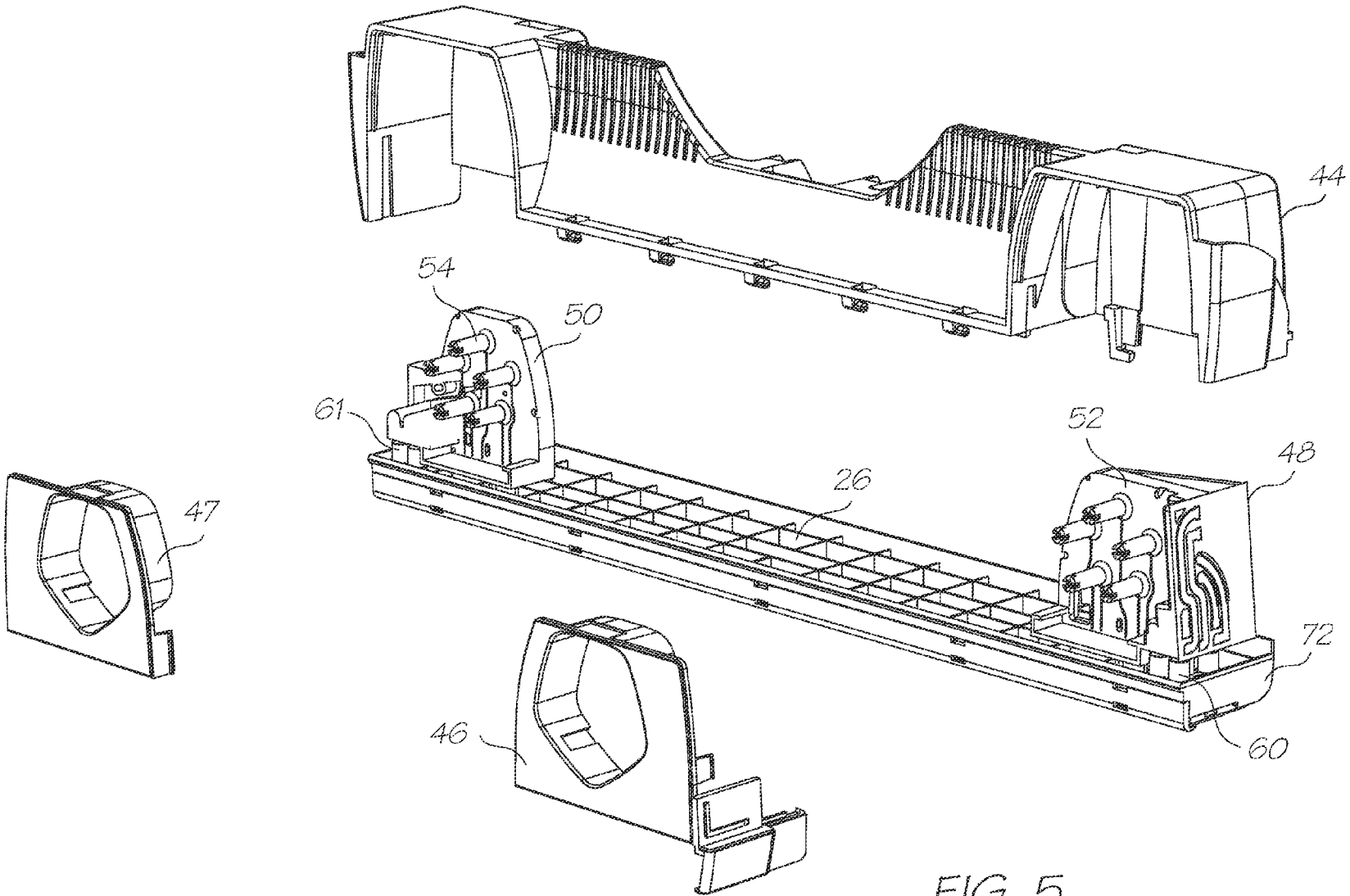
FIG. 5 is an exploded perspective of the printhead cartridge shown in FIG. 3.

FIG. 5 is partially exploded perspective of the printhead cartridge 2. The top cover molding 44 has been removed to reveal the inlet manifold coupling 48 and the outlet manifold coupling 50. Inlet and outlet shrouds 46 and 47 have also been removed to expose the five inlet spouts 52 and five outlet spouts 54. The inlet and outlet spouts 52 and 54 connect with corresponding ink inlets 60 and ink outlets 61 in an LCP cavity molding 72 attached to the inlet and outlet manifolds 48 and 50. The ink inlets 60 and ink outlets 61 are each in fluid communication with corresponding main channels 24 in an LCP channel molding 68 (see FIG. 6).

Figure 6:
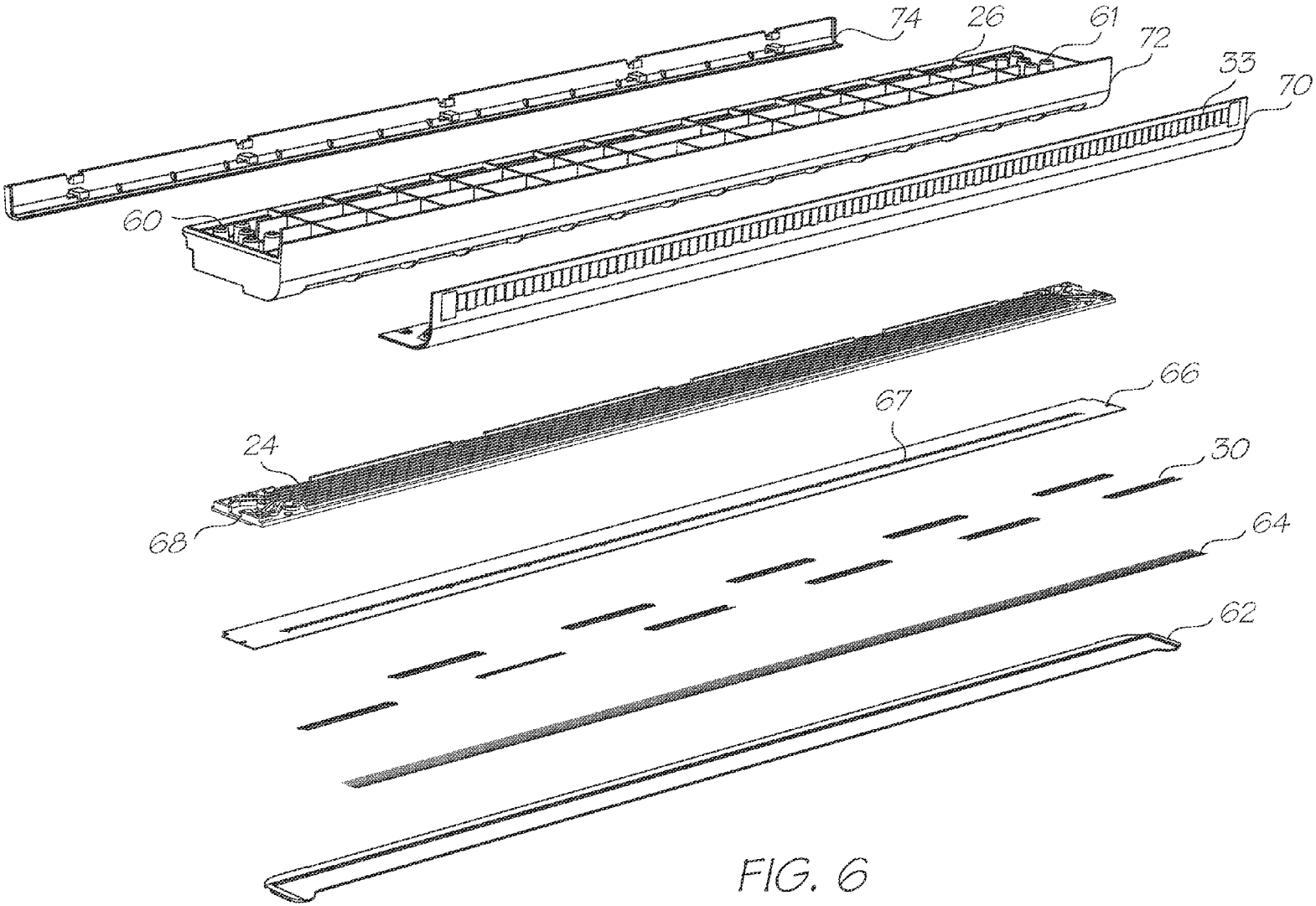
FIG. 6 is an exploded perspective of a printhead, which forms part of the printhead cartridge shown in FIG. 3.

Referring now to FIG. 6, the five main channels 24 extend the length of the LCP channel molding 68 and feed into a series of fine channels (not shown) on the underside of the LCP molding 68. The LCP cavity molding 72, having a plurality of air cavities 26 defined therein, mates with a topside of the LCP channel molding 68 such that the air cavities fluidically communicate with the main channels 24. The air cavities 26 serve to dampen shock waves or pressure pulses in ink being supplied along the main channels 24 by compressing air in the cavities.

A die attach film 66 has one surface bonded to an underside of the LCP channel molding 68 and an opposite surface bonded to a plurality of printhead ICs 30. A plurality of laser-ablated holes 67 in the film 66 provide fluidic communication between the printhead ICs 30 and the main channels 24. Further details of the arrangement of the printhead ICs 30, the film 66 and the LCP channel molding 68 can be found in the US Publication No. 2007/0206056, the contents of which is incorporated herein by reference. Further details of the inlet manifold 48 and outlet manifold 50 can be found in, for example, U.S. application Ser. No. 12/014,769 filed Jan. 16, 2008, the contents of which is incorporated herein by reference.

Electrical connections to the printhead ICs 30 are provided by a flex PCB 70 which wraps around the LCP moldings 72 and 68, and connects with wirebonds 64 extending from bond pads (not shown) on each printhead IC 30. The wirebonds 64 are protected with wirebond protector 62. As described above, the flex PCB 70 includes the contacts 33, which connect with complementary contacts in the print engine 3 when the printhead cartridge 2 is installed for use.

Fluidics System

From the foregoing, it will be appreciated that the printhead cartridge 2 has a plurality of ink inlets 60 and ink outlets 61, which can feed ink through main channels 24 in the LCP channel molding 68 to which printhead ICs 30 are attached. The fluidics system, which supplies ink to and from the printhead, will now be described in detail. For the avoidance of doubt, a "printhead" may comprise, for example, the LCP channel molding 68 together with the printhead ICs 30 attached thereto. Thus, any printhead assembly with at least one ink inlet and, optionally, at least one ink outlet may be termed "printhead" herein.

Figure 7:
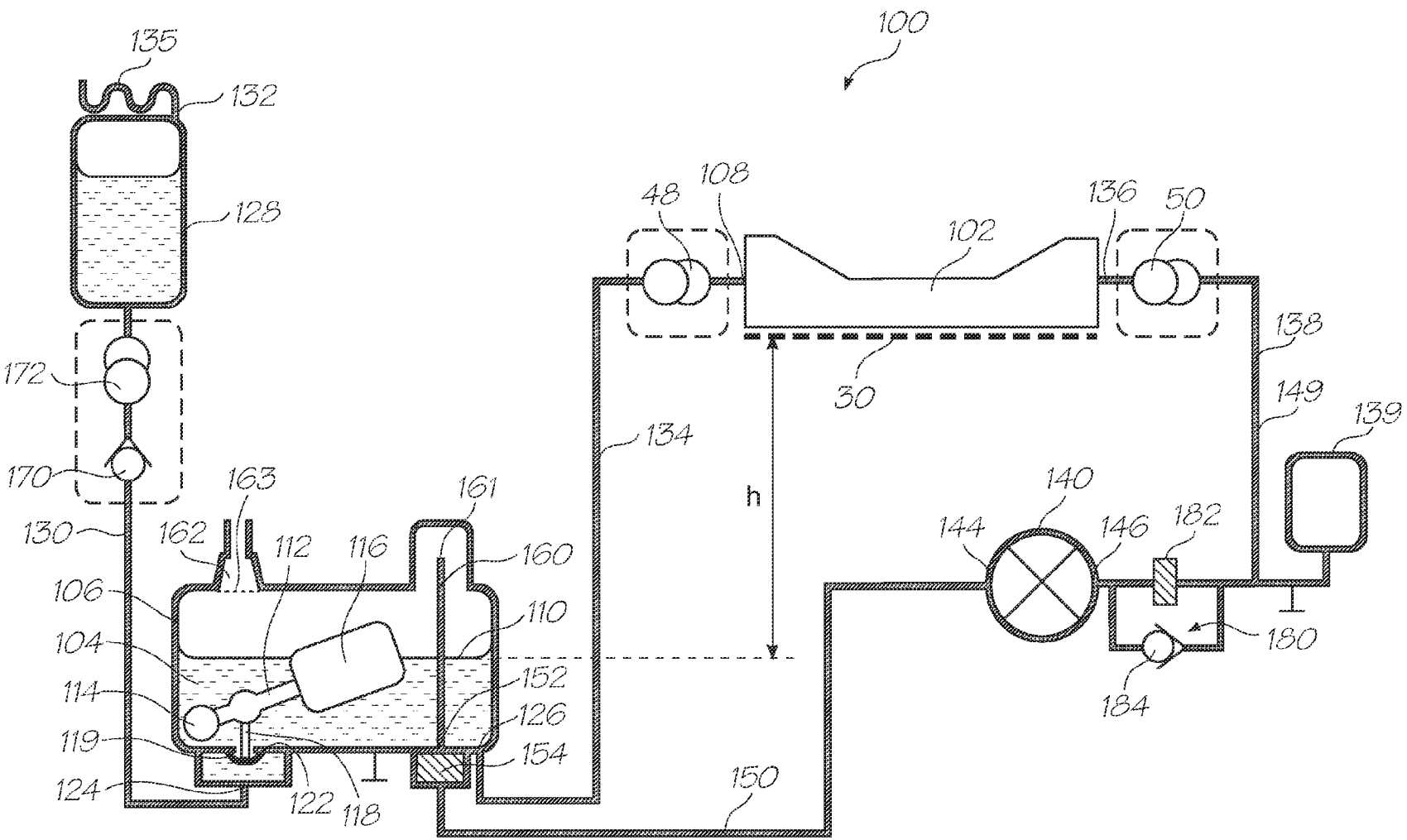
FIG. 7 is a schematic of the fluidics system according to the present invention.

Referring to FIG. 7, there is shown schematically a fluidic system 100 in accordance with the present invention. Relative positioning of each component of the system 100 will be described herein with reference to the schematic drawings. However, it will be appreciated that the exact positioning of each component in the print engine 3 will be a matter of design choice for the person skilled in the art.

For simplicity, the fluidics system 100 is shown for one color channel. Single color channel printheads are, of course, within the ambit of the present invention. However, the fluidics system 100 is more usually used in connection with a full color inkjet printhead having a plurality of color channels (e.g. five color channels as shown in FIGS. 5 and 6). Whilst the following discussion generally relates to one color channel, the skilled person will readily appreciate that multiple color channels may use corresponding fluidics systems.

Normal Printing

Typically, during normal printing, it is necessary to maintain a constant hydrostatic ink pressure in the fluidics system, which is negative relative to atmospheric pressure. A negative hydrostatic ink pressure is necessary to prevent printhead face flooding when printing ceases. Indeed, most commercially available inkjet printheads operate at negative hydrostatic ink pressures, which is usually achieved through the use of a capillary foam in an ink tank.

In the fluidic system 100, a pressure-regulating chamber 106 supplies ink 104 to an ink inlet 108 of the printhead via an upstream ink line 134. The pressure-regulating chamber 106 is positioned below the printhead 102 and maintains a predetermined set level 110 of ink therein. The height h of the printhead 102 above this set level 110 controls the hydrostatic pressure of ink 104 supplied to the printhead. The actual hydrostatic pressure is governed by the well-known equation: $p=\rho gh$, where p is the hydrostatic ink pressure, $\rho$ is the ink density, g is acceleration due to gravity and h is the height of the set level 110 of ink relative to the printhead 102. The printhead 102 is typically positioned at a height of about 10 to 300 mm above the set level 110 of ink, optionally about 50 to 200 mm, optionally about 80 to 150 mm, or optionally about 90 to 120 mm above the set level.

Gravity provides a very reliable and stable means for controlling the hydrostatic ink pressure. Provided that the set level 110 remains constant, then the hydrostatic ink pressure will also remain constant.

The pressure-regulating chamber 106 comprises a float valve for maintaining the set level 110 during normal printing. The float valve comprises a lever arm 112, which is pivotally mounted about a pivot 114 positioned at one of the arm, and a float 116 mounted at the other end of the arm 112. A valve stem 118 is connected to the arm 112, between the pivot 114 and the float 116, to provide a second-class lever. The valve stem 118 has valve head, in the form of an umbrella cap 119, fixed to a distal end of the valve stem relative to the arm 112. The valve stem 118 is slidably received in a valve guide so that the umbrella cap 119 can sealingly engage with a valve seat 122. This valve arrangement controls flow of ink through an inlet port 124 of the pressure-regulating chamber 106. The inlet port 124 is positioned towards a base of the chamber 106.

The set level 110 is determined by the buoyancy of the float 116 in the ink 104 (as well as the position of the chamber 106 relative to the printhead 102). The umbrella cap 119 should seal against the seat 122 at the set level 110, but should unseal upon any downward movement of the float 116 (and thereby the valve stem 118). Preferably, there should be minimum hysteresis in the float valve so as to minimize variations in hydrostatic pressure.

Figure 8B:
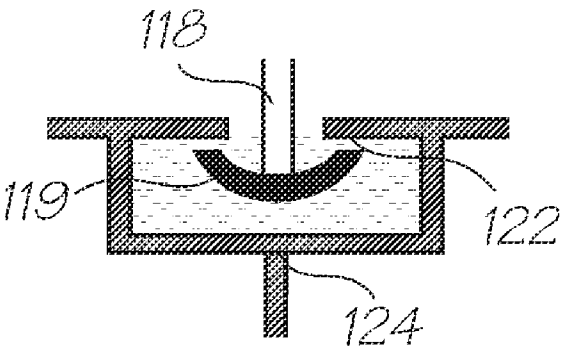
FIG. 8B shows the valve arrangement of FIG. 8A in an open position.
Figure 8A:
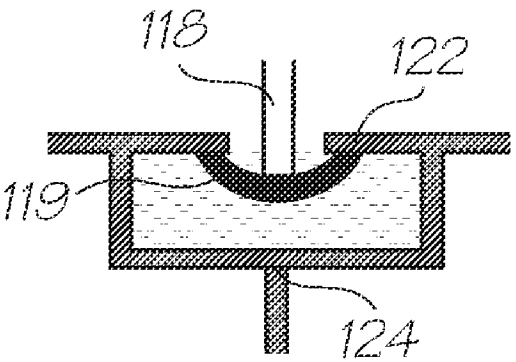
FIG. 8A shows a valve arrangement in closed position.

When the float valve is closed, the umbrella cap 119 is urged against the seat 122 (defined by an outer surface of a base of the chamber) by positive ink pressure from the ink reservoir 128. This positive sealing pressure minimizes any ink leakages from the chamber 106 via the inlet port 124 when the valve is closed. FIG. 8A shows the valve in a closed position, with the umbrella cap 119 engaged with the valve seat 122.

As ink 104 is drawn from an outlet port 126 of the chamber 106 during normal printing, the float 116 incrementally moves downwards, which unseats the umbrella cap 119 and opens the inlet port 124, thereby allowing ink to refill the chamber from the ink reservoir 128 positioned above the chamber. In this way, the set level 110 is maintained and the hydrostatic ink pressure in the printhead 102 remains constant. FIG. 8B shows the valve in an open position, with the umbrella cap 119 unseated from the valve seat 122.

The float 116 preferably occupies a relatively large volume of the chamber 106 so as to provide maximum valve closure force. This closure force is amplified by the lever arm 112. However, the float 116 should be configured so that it does not touch sidewalls of the chamber 106 so as to avoid sticking.

Ink 104 is supplied to the pressure-regulating chamber 106 by the ink reservoir 128 positioned at any height above the set level 110. The ink reservoir 128 is typically a user-replaceable ink tank or ink cartridge, which connects with an ink supply line 130 when installed in the printer. The ink supply line 130 provides fluidic communication between the ink reservoir 128 and the inlet port 124 of the pressure-regulating chamber 106.

The ink reservoir 128 vents to atmosphere via a first air vent 132, which opens into a headspace of the ink reservoir. Accordingly, the ink 104 can simply drain into the pressure-regulating chamber 106 when the float valve opens the inlet port 124. The vent 132 comprises a hydrophobic serpentine channel 135, which minimizes ink losses through the vent when the ink cartridge is tipped. The vent 132 may also be covered by a one-time use sealing strip (not shown), which is removed prior to installation of an ink cartridge in the printer.

The printhead 102 has an ink inlet 108, which connects to the outlet port 126 via an upstream ink line 134. The printhead 102 is removable by means of the inlet and outlet couplings 48 and 50.

It will be understood that pressure-regulation as described above may be achieved with 'closed' printheads having an ink inlet, but no ink outlet. However, for the purposes of priming (described below), the printhead 102 shown in FIG. 7 also has an ink outlet 136, which is connected to a downstream ink line 138 via the outlet coupling 50. The downstream ink line 138 is connected to a return port 152 of the chamber 106 and comprises an inline peristaltic ink pump 140. The pump 140 divides the downstream ink line into a pump inlet line 149 and a pump outlet line 150.

The return port 152 is positioned at the base of the chamber and is connected to a snorkel 160 which extends towards the roof of the chamber above the level of ink 104. The pump outlet line 150 has an inline filter 154 between the pump 140 and the return port 152. The chamber 106 and snorkel 160 are configured so that a snorkel outlet 161 is always above the level of ink 104, even if the level of ink reaches the roof the chamber. For example, the snorkel outlet 161 may be positioned in a roof cavity of the chamber 106. It will be appreciated that the snorkel 160 may be defined by a channel or cavity in a sidewall of the chamber so as to maximize space inside the chamber 106.

During normal printing, the pump 140 is left open and the hydrostatic pressure of ink in the fluidics system 100 is controlled solely by the set level 110 of ink in the pressure-regulating chamber 106. A second air vent 162 is provided in a roof of the chamber 106, and communicates with a headspace via an air-permeable membrane 163 (e.g. Goretex®). Since ink 104 in the upstream ink line 134 and the downstream ink line 138 is open to atmosphere via the second air vent 164, this ink is held at the same hydrostatic pressure. Hence, ink in the snorkel 160 equilibrates at the set level 110 during normal printing when the pump 140 is left open. To this end, it is important that the downstream ink line 138 has a "loop section" 137 which passes below the level of the set level 110, allowing equilibration of the upstream and downstream sides of the printhead 102 to the set level. The return port 152, positioned in the base of the pressure-regulating chamber 106, and the snorkel 160 effectively ensure that this is the case.

Dampening of Ink Pressure Surges

As mentioned above, the printhead 102 is provided with a plurality of air cavities 26, which are configured to dampen fluidic pressure pulses as ink is supplied to printhead nozzles. Ink pressure surges are problematic in high-speed pagewidth printing and high quality printing is preferably achieved when ink is supplied at a substantially constant hydrostatic pressure. The air cavities 26 are configured and dimensioned to dampen high-frequency pressure pulses in the fluidics system by compressing air trapped in the cavities.

In order to dampen low-frequency ink pressure pulses, the pump inlet line 149 (which is a section of the downstream ink line 138) communicates with an air accumulator 139 having a larger volume than each of the air cavities 26. Low-frequency ink pressure pulses are dampened by compressing air trapped in the air accumulator 139.

The air accumulator 139 may alternatively form part of the printhead 102, although positioning in the downstream ink line 138 is preferred, since over-dampening in the printhead can adversely affect the ability of the printhead to prime.

The combination of the air cavities 26 and the air accumulator 139 provides excellent dampening of both high-frequency and low-frequency ink pressure pulses during normal printing. Moreover, the gravity-controlled supply of ink from the pressure-regulating chamber 106 provides a stable and accurate hydrostatic pressure in the fluidics system 100 during printing.

Printhead Priming

Printhead priming may be required after replacement of a printhead 102, when a printer is first set up, or when a printer has been left idle for long periods. Printhead priming requires ink 104 to be fed into the ink inlet 108 of the printhead 102 via the upstream ink line 134, through the printhead 102 and out again via the ink outlet 136 connected to the downstream ink line 138. Once the ink 104 is fed through the main channels 24 in the LCP channel molding 68 of the printhead 102, the printhead ICs 30 are primed by capillary action.

Referring to FIG. 7, the reversible peristaltic pump is switched on in a forward (i.e. priming direction) so as to pump ink from the outlet port 126, through the printhead 102 and back to the return port 152. In this priming configuration, the pump 140 has an arbitrary pump outlet 144 and a pump inlet 146. Self-evidently, since the pump is reversible, the pump outlet 144 and inlet 146 may be reversed. However, for the sake of clarity, the system 100 is described with reference to the arbitrary pump outlet and inlet designations defined above.

Pumping is timed and may be continued for a period necessary to fully prime the printhead 102 and/or pump out all air bubbles from the fluidics system 100. Hence, even if the printhead 102 has already been primed, a priming operation may still be required to eradicate air bubbles, which may have accumulated since the last priming operation (for example, by atmospheric pressure changes, atmospheric temperature fluctuations, printhead cooling etc). It should be noted that recycling of ink via the return port 152 during priming ensures that no ink is wasted, even if ink is pumped through the system for a relatively long period e.g. 5-30 seconds.

An inline filter 154 is positioned between the return port 152 and the pump outlet 144 to protect the printhead 102 from any potential pump debris during priming. The filter 154 may be a component of the pressure-regulating chamber 106, as shown schematically in FIG. 7.

When ink 104 is pumped from the chamber 106 to a deprimed printhead, the level of ink 104 in the chamber initially drops as the ink fills up the LCP channels 24 and downstream ink line 138. When the level of ink in the chamber 106 drops, the float valve opens the inlet port 124, allowing ink in the chamber to be replenished from the ink reservoir 128 (by analogy with the operation of the float valve during normal printing). Hence, the float valve can maintain the set level 110 during initial priming. After a short period of pumping, equilibrium is reached whereby ink drools from the snorkel outlet 161 at the same rate as ink is being pumped from the outlet port 126. Since the level of ink in the chamber is at the set level 110, the inlet port is closed by the float valve once ink begins to flow from the snorkel outlet 161. Ink may be circulated around the system in this equilibrium state for any period sufficient to ensure removal of air bubbles, and without wasting any ink.

During priming (or depriming), the ink reservoir 128 is protected from any backflow of ink from the chamber 106 by an inline check-valve 170. The check valve 170 is positioned in the ink supply line 130 interconnecting the ink reservoir 128 and the inlet port 124, typically as part of a coupling 172 to the ink reservoir. The check valve 170 allows ink to drain from the ink reservoir 128 into the chamber 106, but does not allow ink to flow in the opposite direction.

Printhead Depriming

In order to replace a printhead 102, the old printhead must first be deprimed. Without such depriming, replacement of printheads would be an intolerably messy operation. During depriming, the peristaltic pump 140 is reversed and ink is drawn from the downstream ink line 138, through the printhead 102, and back into the pressure-regulating chamber 106 via the outlet port 126.

Since the level of ink 104 in the pressure-regulating chamber 106 now rises, the float valve closes the inlet port 124, thereby isolating the chamber 106 from the ink reservoir 128. Hence, the float valve not only regulates the hydrostatic ink pressure during normal printing, but also serves to isolate the pressure-regulating chamber 106 from the ink reservoir 128 during depriming. Of course, the pressure-regulating chamber should have sufficient capacity to accommodate the ink received therein during depriming.

Significantly, there is minimal or no ink wastage during depriming, because ink in the printhead 102 and downstream conduit 138 is all recycled back into the pressure-regulating chamber 106 for re-use.

A filter system 180 protects the printhead 102 from potential pump debris during depriming. The filter system 180 comprises an inline filter 182 in the pump inlet line 149 and an optional check-valve loop 184, which ensures ink is forced through the filter 182 during de-priming but not during priming. Hence, any pump debris is confined in the section of the downstream ink line 138 between the two filters 154 and 182, and cannot therefore contaminate the printhead 102.

Once all the ink in the downstream ink line 138, the printhead 102 and the upstream ink line 134 has been drawn into the pressure-regulating chamber 106, the pump 140 is switched off. The pump 140 is typically switched off after predetermined period of time (e.g. 2-30 seconds). When the pump is switched off, some ink 104 from the pressure-regulating chamber 106 flows into the upstream line 134 until it equalizes with the level of ink in the chamber 106. Since, at this stage of depriming, the volume of ink 104 in the pressure-regulating chamber is relatively high, the ink equalizes at a level higher than the set level 110, and the float valve keeps the inlet port 124 closed. Hence, ink 104 is prevented from draining from the ink reservoir 128 into the upstream ink line 134, because the float valve isolates the ink reservoir from the chamber 106.

After the depriming operation and with the pump is switched off, the printhead 102 may be removed and replaced with a replacement printhead. Since the printhead 102 is drained of ink by the depriming operation, the replacement operation may be performed relatively cleanly.

Once installed, the replacement (unprimed) printhead may be primed by the priming operation described above.

It will, of course, be appreciated that the present invention has been described purely by way of example and that modifications of detail may be made within the scope of the invention, which is defined by the accompanying claims.

The invention claimed is:

1. A pressure-regulating chamber for maintaining ink contained therein at a predetermined first level relative to a printhead, said chamber comprising:

an inlet port for connection to an ink reservoir via an ink supply line;

an outlet port for connection to an ink inlet of a printhead via an upstream ink line;

an air vent open to atmosphere, said air vent communicating with a headspace above said ink; and a float valve for maintaining said predetermined first level of ink by controlling a flow of ink into said inlet port, wherein said float valve is biased towards a closed position by a positive ink pressure at said inlet port, wherein said float valve comprises:

an arm pivotally mounted about a pivot;

a float mounted at one end of said arm; and a valve stem attached to said arm, said valve stem having a valve head for closure of a valve seat, said valve seat being positioned at the inlet port of said pressure-regulating chamber.

2. The pressure-regulating chamber of claim 1, wherein said valve head comprises an umbrella sealing cap for closure of the valve seat.

3. The pressure-regulating chamber of claim 2, wherein an outer surface of a base of said chamber comprises said valve seat.

4. The pressure-regulating chamber of claim 3, wherein said float valve is configured such that downward movement of said valve stem towards said base unseats said umbrella cap from said valve seat.

5. The pressure-regulating chamber of claim 4, wherein said positive ink pressure at said inlet port urges said umbrella sealing cap against said valve seat.

6. The pressure-regulating chamber of claim 5, wherein the positive ink pressure is provided by said ink reservoir positioned above said chamber.

7. The pressure-regulating chamber of claim 1, wherein said valve stem is positioned between said pivot and said float.

8. The pressure-regulating chamber of claim 1, wherein said inlet port and said outlet port are positioned towards a base of said chamber.

9. The pressure-regulating chamber of claim 1, comprising a return port positioned at a base of said chamber.

10. The pressure-regulating chamber of claim 1, wherein said air vent comprises an air-permeable membrane, which is impervious to ink.

11. The pressure-regulating chamber of claim 1, wherein said return port comprises an inline ink filter.

* * * * *